US008333022B2

(12) United States Patent
Crowley, II et al.

(10) Patent No.: US 8,333,022 B2
(45) Date of Patent: Dec. 18, 2012

(54) ARTICLES OF FOOTWEAR

(75) Inventors: Kevin J. Crowley, II, Newbury, MA (US); David M. Nau, Wayland, MA (US); Marc R. Loverin, Scituate, MA (US)

(73) Assignee: SRL, LLC, Lexington, MA (US)

( * ) Notice: Subject to any disclaimer, the term of this patent is extended or adjusted under 35 U.S.C. 154(b) by 270 days.

(21) Appl. No.: 12/847,063

(22) Filed: Jul. 30, 2010

(65) Prior Publication Data

US 2011/0016750 A1 Jan. 27, 2011

Related U.S. Application Data

(63) Continuation-in-part of application No. 12/623,692, filed on Nov. 23, 2009.

(60) Provisional application No. 61/117,364, filed on Nov. 24, 2008.

(51) Int. Cl.
*A43B 13/38* (2006.01)
*A43B 13/18* (2006.01)

(52) U.S. Cl. ..... 36/43; 36/28; 36/102

(58) Field of Classification Search ..... 36/43, 28, 36/102, 44, 141, 71
See application file for complete search history.

(56) References Cited

U.S. PATENT DOCUMENTS

| | | | | |
|---|---|---|---|---|
| 4,017,931 | A * | 4/1977 | Golden | 12/146 B |
| 4,670,995 | A * | 6/1987 | Huang | 36/29 |
| 5,167,999 | A * | 12/1992 | Wang | 428/178 |
| 7,383,648 | B1 * | 6/2008 | Litchfield et al. | 36/29 |
| 2011/0016750 | A1 * | 1/2011 | Crowley et al. | 36/103 |
| 2011/0041365 | A1 * | 2/2011 | Ludemann | 36/3 R |

* cited by examiner

*Primary Examiner* — Ted Kavanaugh
(74) *Attorney, Agent, or Firm* — Honigman Miller Schwartz and Cohn LLP

(57) ABSTRACT

A footbed promotes complimentary movement and proprioceptive feedback of a user's foot (e.g., to help an adult balance on an uneven surface) while wearing the article of footwear. The footbed includes a base and a plurality of pads. The base has a first side opposite a second side, each extending from a forefoot region to a heel region. A first portion of each pad extends away from the first side of the base and a second portion of each pad extends away from the second side of the base. The second side of the base is positionable adjacent to an outsole of an article of footwear such that the first side of the base is adjacent a user's foot during use of the article of footwear. Each pad is movable substantially independently of the each of the other pads, relative to the base.

17 Claims, 22 Drawing Sheets

ARTICLES OF FOOTWEAR

CROSS REFERENCE TO RELATED APPLICATIONS

This U.S. patent application is a continuation-in-part of U.S. patent application Ser. No. 12/623,692, filed Nov. 23, 2009, which claims priority under 35 U.S.C. §119(e) to U.S. Provisional Application 61/117,364, filed on Nov. 24, 2008. Each of the foregoing applications is hereby incorporated by reference in its entirety.

TECHNICAL FIELD

This disclosure relates to articles of footwear that provide complementary movement and/or proprioceptive feedback.

BACKGROUND

Generally, infant shoes include an upper portion and a sole. When the upper portion is secured to the sole, the upper portion along with the sole define a void that is configured to securely and comfortably receive and hold an infant's foot. Often, the upper portion and/or sole are/is formed from multiple layers that can be stitched or adhesively bonded together. For example, the upper portion can be made of a combination of leather and fabric, or foam and fabric, and the sole can be formed from at least one layer of rubber. Often materials are chosen for functional reasons, e.g., water-resistance, durability, abrasion-resistance, and breathability, while shape, texture, and color are used to promote the aesthetic qualities of the infant shoe.

SUMMARY

The present disclosure provides an article of footwear that promotes complimentary movement and/or proprioceptive feedback of an user's foot for a range of activities that may include walking, crawling, standing, turning, cruising (e.g., walking while holding onto a support object), climbing, etc. An infant relies on the sensations felt by his/her feet to learn to walk and an article of footwear that promotes, rather than masks, translation of the ground contours and contact forces helps the infant learn to walk while still providing a protective covering over the infant's foot. Therefore, the article of footwear needs to be flexible for bending with the foot and a forefoot portion of the sole needs to be thin enough to allow translation of ground contact forces. Besides providing a protective covering, the article of footwear may also provide a certain degree of stability and agility to the infant's foot, such as ground contact conformability, bending, complimentary movement, and torsion control, so that the infant's foot is not completely free to twist.

Pre-school children (e.g., 2-6 years old) children generally need shoes that provide natural or complimentary movement of the feet, thus allowing them to sense (e.g., via proprioceptive feedback) the ground, ladders, bike pedals, etc. under their feet, and provide them with a high level of stability and agility for performing a wide range of activities.

Post pre-school children (e.g., over 6 years of age) and adults can also benefit from shoes that provide complimentary movement and allow proprioceptive feedback therethrough. Such shoes can aid post pre-school children in activities that include (but not limited to) playground activities, wall/rock climbing, balancing, etc.

In one aspect, an article of footwear includes an outsole having a forefoot region, a heel region, and a mid region substantially in between the forefoot and heel regions. The forefoot region of the outsole includes a base portion interconnecting ground contact pads configured to move relative to one another. Each ground contact pad moves substantially independently of the other relative to the base portion.

Implementations of this aspect of the disclosure may include one or more of the following features. In some implementations, the article of footwear includes a flex portion at least partially circumscribing each ground contact pad and attaching each ground contact pad to the base portion. The flex portion may comprise an elastic material, such that the flex portion elastically deforms to allow movement of the associated ground contact pad. In some examples, the flex portion includes at least one groove defined by the base portion interconnecting the ground contact pads. The flex portion may define substantially corrugated or undulated shape, which is amenable to bending and flexing for allowing movement of the associated ground contact pad. In some implementations, the flex portion has a thickness less than a thickness of the ground contact pad. Also, the base portion may have a thickness less than at least one of the mid region and the heel region.

In some implementations, the mid region has a torsional stiffness of between about 15 degrees/N*m and about 75 degrees/N*m. In some examples, the mid region of the outsole includes a torsion control portion defining a substantially cruciform shape from a bottom view of the outsole. The torsion control portion may comprise a composite material or a combination of attached materials to provide a desired torsional resistance for the mid region of the outsole.

In another aspect, an article of footwear includes an outsole having a forefoot region, a heel region, and a mid region substantially in between the forefoot and heel regions. The outsole defines a sagittal axis, a front axis, and a transverse axis. The outsole is configured to allow bending of the forefoot region about at least one of the sagittal axis and the front axis, and substantially inhibit bending about the transverse axis. The mid region includes a torsion control portion defining a substantially cruciform shape from a bottom view of the outsole and having a torsional stiffness greater than the forefoot and heel regions.

Implementations of this aspect of the disclosure may include one or more of the following features. In some implementations, the mid region has a torsional stiffness of between about 15 degrees/N*m and about 75 degrees/N*m. In some examples, the forefoot region is allowed to bend about the sagittal axis to a 45 degree angle when a force of between about 0.5 kg to about 3.5 kg is applied to an intersection of the forefoot region and the mid region (e.g., when the heel region is held stationary). The forefoot region is allowed to deflect less than about 5 mm about the transverse axis away from the front axis when a force of about 5 kg is applied to an intersection of the forefoot region and the mid region (e.g., when the heel region is held stationary).

In some implementations, the forefoot region of the outsole includes a base portion interconnecting ground contact pads configured to move relative to one another, each ground contact pad moving substantially independently of the other. The article of footwear may include a flex portion at least partially circumscribing each ground contact pad and attaching each ground contact pad to the base portion. The flex portion may comprise an elastic material, such that the flex portion elastically deforms to allow movement of the associated ground contact pad. In some examples, the flex portion includes at least one groove defined by the base portion interconnecting the ground contact pads. An exemplary flex portion defines a substantially corrugated shape. The flex portion has a thickness less than a thickness of the ground contact pad for providing a region of relatively greater flexibility and bendability so that the ground contact pads can move relative to one another. Also, the base portion has a thickness less than at least one of the mid region and the heel region Implementations of the disclosure may include one or more of the following features. In some implementations, the heel region of the outsole includes an outer heel member having an inner heel region, and an inner heel member located in the inner heel region. The inner heel member has a ground contacting surface and a relatively lower durometer than the outer heel member. The inner heel member is positioned and dimensioned to fit under a user's heel during use of the article of footwear. The outer heel member has a durometer of between about 40 Shore A and about 70 Shore A. The inner member has a durometer of between about 30 Shore A and about 60 Shore A. In some examples, the heel region includes a heel cushion portion disposed on the inner heel member and having a durometer of between about 25 Asker C and about 55 Asker C.

In some implementations, the article of footwear includes an insole disposed on the outsole, for example, in the forefoot, mid, and heel regions. The insole is attached to the ground contact pads in the forefoot region while remaining substantially unattached to a base portion interconnecting the contact pads in the forefoot region. By attaching the insole to the ground contact pads and not the base portion interconnecting the ground contact pads, the ground contact pads are allowed to move relative the base portion to translate contours and forces to the user's foot.

In some implementations, a footbed includes a base and a plurality of pads. The base has a first side opposite a second side, the first and second side each extending from a forefoot region to a heel region. Each pad has a first portion substantially opposite a second portion, the first portion extending away from the first side of the base and the second portion extending away from the second side of the base. The second side of the base is positionable adjacent to an outsole of an article of footwear such that the first side of the base is adjacent a user's foot during use of the article of footwear. Each pad is movable substantially independently of the each of the other pads, relative to the base, in response to a force applied to the respective pad during use of the article of footwear. The plurality of pads can be interconnected by the base. At least some the plurality of pads can be arranged on a triangular spherized grid or hexagonal spherized grid. The base can have a forefoot region with a sagittal dimension greater than the sagittal dimension of the heel region of the base.

In some aspects, the base defines a plurality of orifices extending from the first side of the base to the second side of the base, each of the plurality of pads disposed in a corresponding orifice and free to move within the orifice.

In certain aspects, the base has a substantially uniform thickness of between about 0.5 mm to about 6 mm from the forefoot region to the heel region.

In some aspects, at least some of the plurality of pads are disposed along the forefoot region and at least some of the plurality of pads are disposed along the heel region, the pads at the heel region having a thickness greater than the pads at the forefoot region. In some examples, the first portion of each of the plurality of pads extends away from the first side of the base by a substantially uniform distance. In certain examples, the second portion of at least one of the pads extends away from the second side of the base by a distance greater than at least one of the other pads (e.g., between about 0.5 mm to about 2 mm greater than at least one of the other pads). The at least one pad extending away from the second side by a distance greater than at least one of the other pads can be disposed along the forefoot region, the heel region, and/or the midsole region.

In certain aspects, the second portion of each pad at the forefoot region extends away from the second side of the base by a first distance and the second portion of each pad at the heel region extends away from the second side of the base by a second distance greater than the first distance. In some examples, the first distance is between about 0.5 mm and about 4 mm and the second distance is between about 5 mm and about 15 mm.

In some aspects, at least some of the plurality of pads have a substantially elliptical shape and at least some of the plurality of pads are arranged in a spherized grid pattern.

In certain aspects, at least some of the plurality of pads are disposed along the base such that at least one of the pads contacts the ball of a user's foot during use of the article of footwear.

In some aspects, the base and the plurality of pads are made of: polyurethane foam and/or ethylene vinyl acetate. The base can have a durometer of between about 30 Asker C and about 70 Asker C.

In some implementations, an article of footwear includes an outsole and a footbed. The outsole has a forefoot region, a heel region, and a midsole region substantially between the forefoot region and the heel region. The footbed includes a plurality of pads and a base, the base having a first side opposite a second side and a plurality of pads. Each pad has a first portion substantially opposite a second portion, the first portion extending away from the first side of the base and the second portion extending away from the second side of the base. The second side of the base is adjacent the outsole such that the first side of the base is adjacent a user's foot during use of the article of footwear. Each pad is movable substantially independently of the each of the other pads, relative to the base, in response to a force applied to a portion of the outsole adjacent to the respective pad during use of the article of footwear. In some examples, at least a portion of the footbed can be fastened to the outsole such that the footbed is substantially fixed relative to the outsole. In certain examples, the footbed is moveable relative to the outsole such that the footbed is removable from the article of footwear.

In some aspects, the forefoot region of the outsole includes a base portion interconnecting ground contact pads movable substantially independently of one another relative to the base portion. The ground contact pads are substantially aligned with at least some of the plurality of pads.

The details of one or more implementations of the disclosure are set forth in the accompanying drawings and the description below. Other aspects, features, and advantages will be apparent from the description and drawings, and from the claims.

Like reference symbols in the various drawings indicate like elements. By way of example only, all of the drawings are directed to a shoe suitable to be worn on a user's left foot. The invention includes also the mirror images of the drawings, i.e. a shoe suitable to be worn on the user's right foot.

DETAILED DESCRIPTION

Infants (e.g., babies) have substantially rounded feet, unlike adolescents and adults whom have relatively elongated feet with pronounced arch development. Infants generally experience relatively quick muscle growth and coordination development. An infant learns to walk and develops a gait through coordination development and receiving proprioceptive feedback from nerve endings in its feet. The most influential time for gait development is between about 9 and 24 months of age. As a result, an infant shoe configured to allow or promote complimentary movement and proprioceptive feedback while donned on an infant's foot will likely aid the infant in learning to walk, development of a natural gait, and reduce stubbles and falls. Furthermore, an infant shoe configured to cradle an infant's foot and mimic the infant foot shape is advantageous, for movement, comfort, and fit.

Pre-school children (e.g., 2-6 years old) undergo significant foot development—bone formation, muscle and tendon development, etc—as well as a relatively large amount of activity development—walking proficiency, as well as running, jumping, climbing, rolling, twisting, bike riding, etc. The feet of pre-school children generally need shoes that provide natural or complimentary movement of the feet, thus allowing them to sense (e.g., via proprioceptive feedback) the ground, ladders, bike pedals, etc. under their feet, and provide them with a high level of stability and agility for performing a wide range of activities.

Post pre-school children (e.g., over 6 years of age) and adults can also benefit from shoes that provide complimentary movement and allow proprioceptive feedback therethrough. Such shoes can aid post pre-school children in activities that include (but not limited to) playground activities, wall/rock climbing, etc. Such shoes can aid adults in activities that include (but not limited to) fishing on rock jetties, walking or fishing in lakes, rivers, ocean with rocky surfaces, etc.

The present disclosure describes articles of footwear that provide a user with proprioceptive feedback of the ground (via ground contract pads), multi-directional flexibility, enhanced matched foot ground contact, a complimentary foot bed that allows sensing of the ground contract pads and pressure distribution due to conforming/molding to the foot bed, and shaping of the articles of footwear to substantially match the user's feet.

Figure 1:
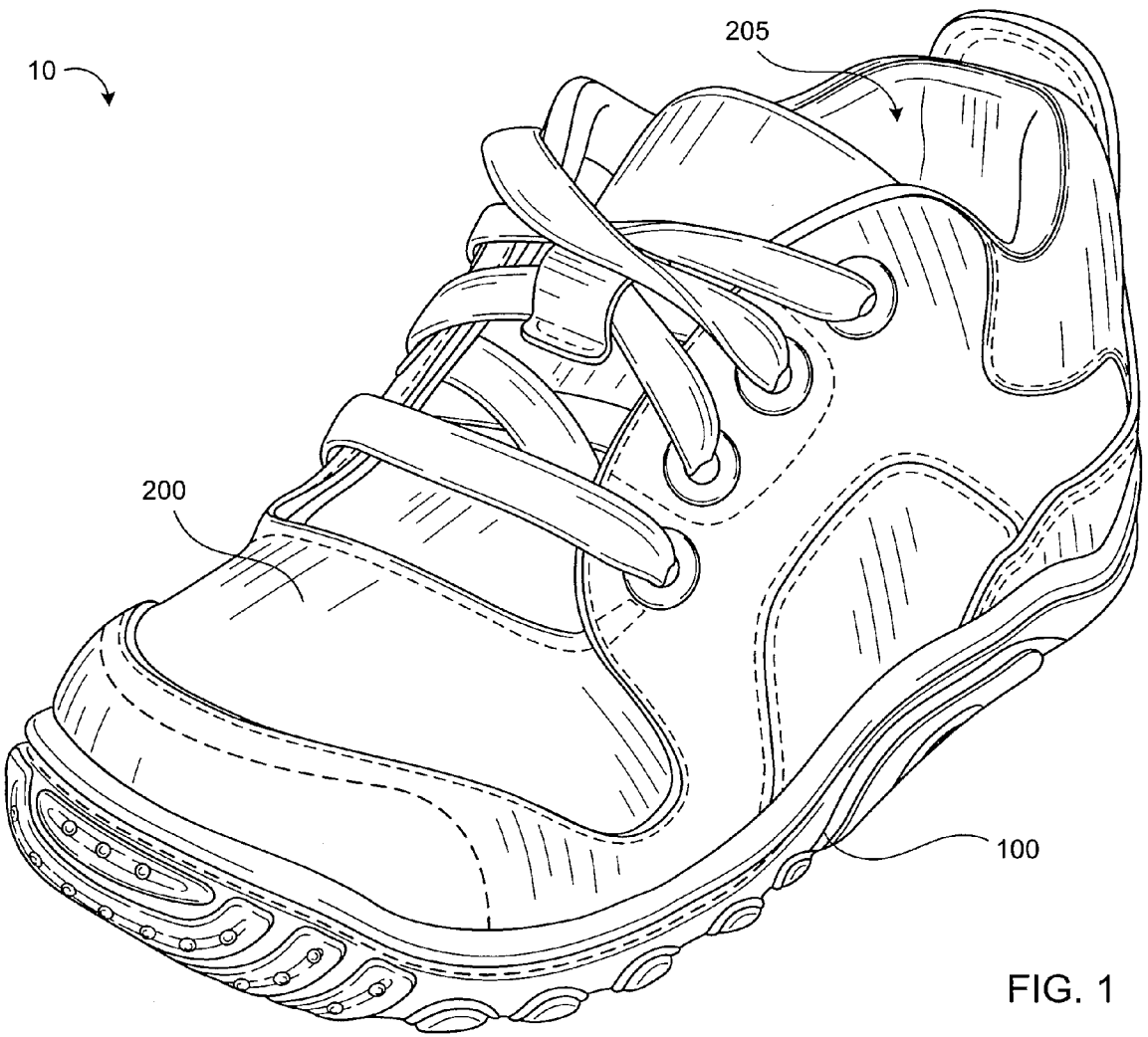
FIG. 1 is a front perspective view of an article of footwear.
Figure 2:
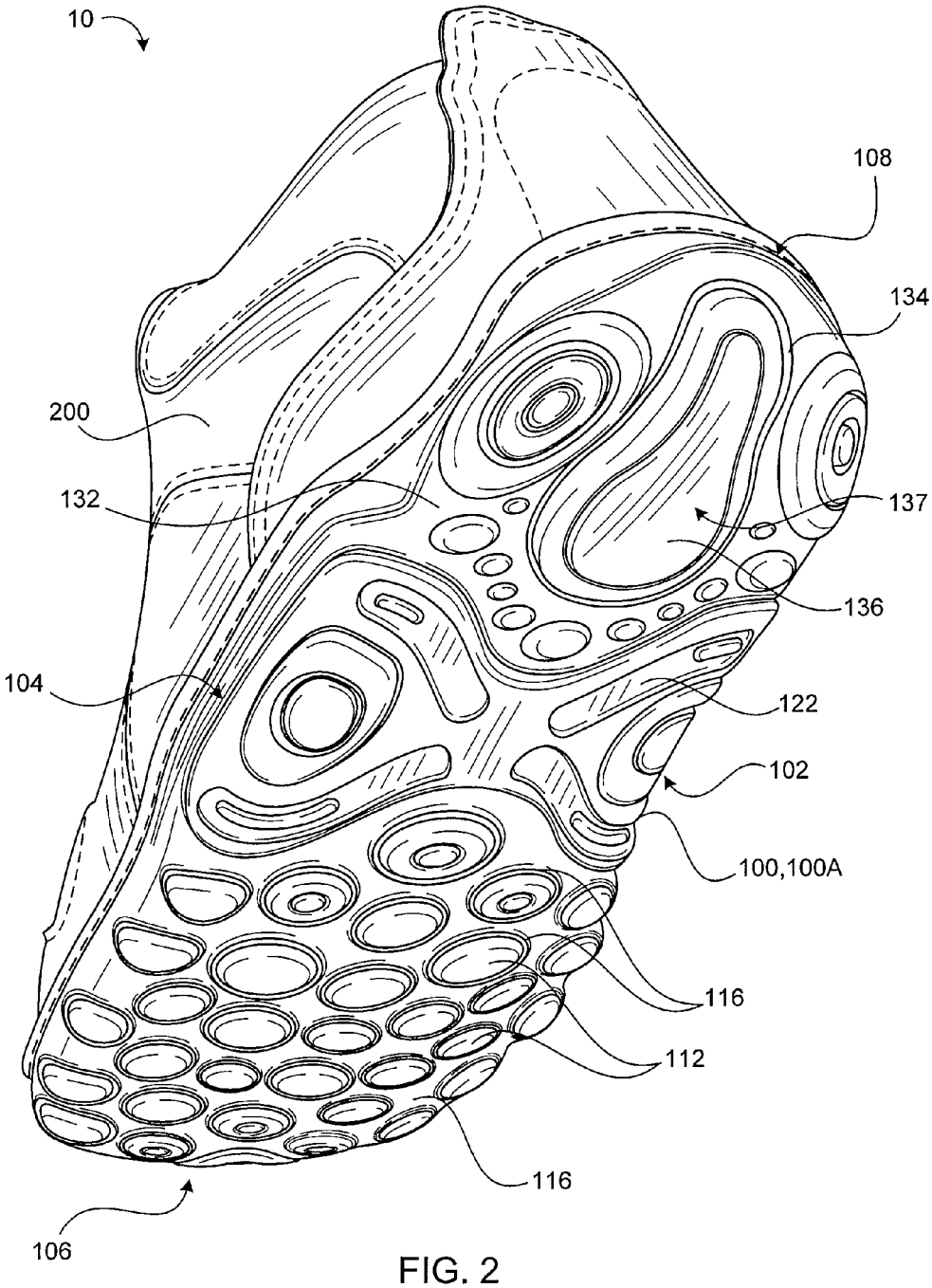
FIG. 2 is a rear perspective view of an article of footwear.
Figure 3:
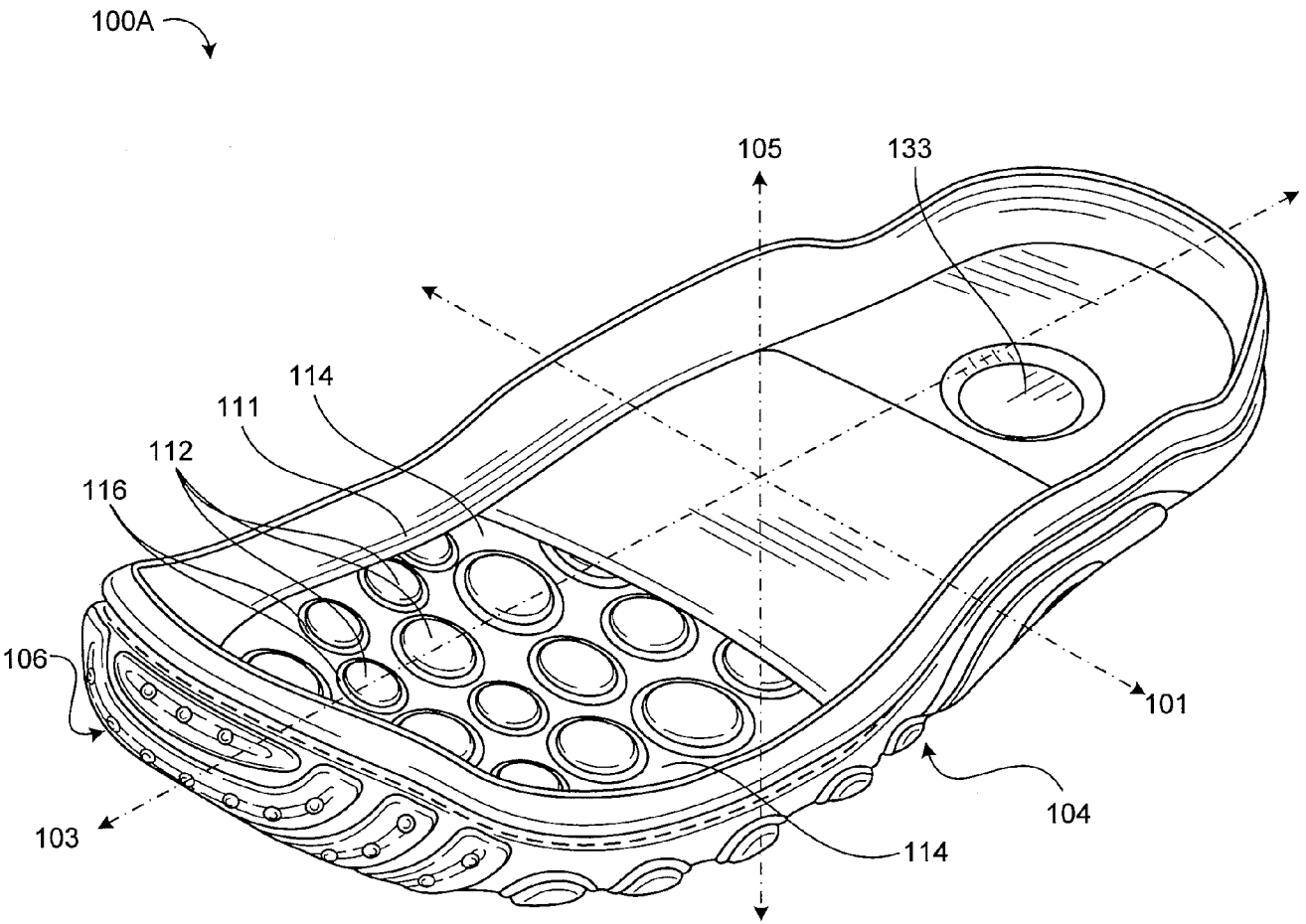
FIG. 3 is a top, front perspective view of an outsole for an article of footwear.
Figure 4:
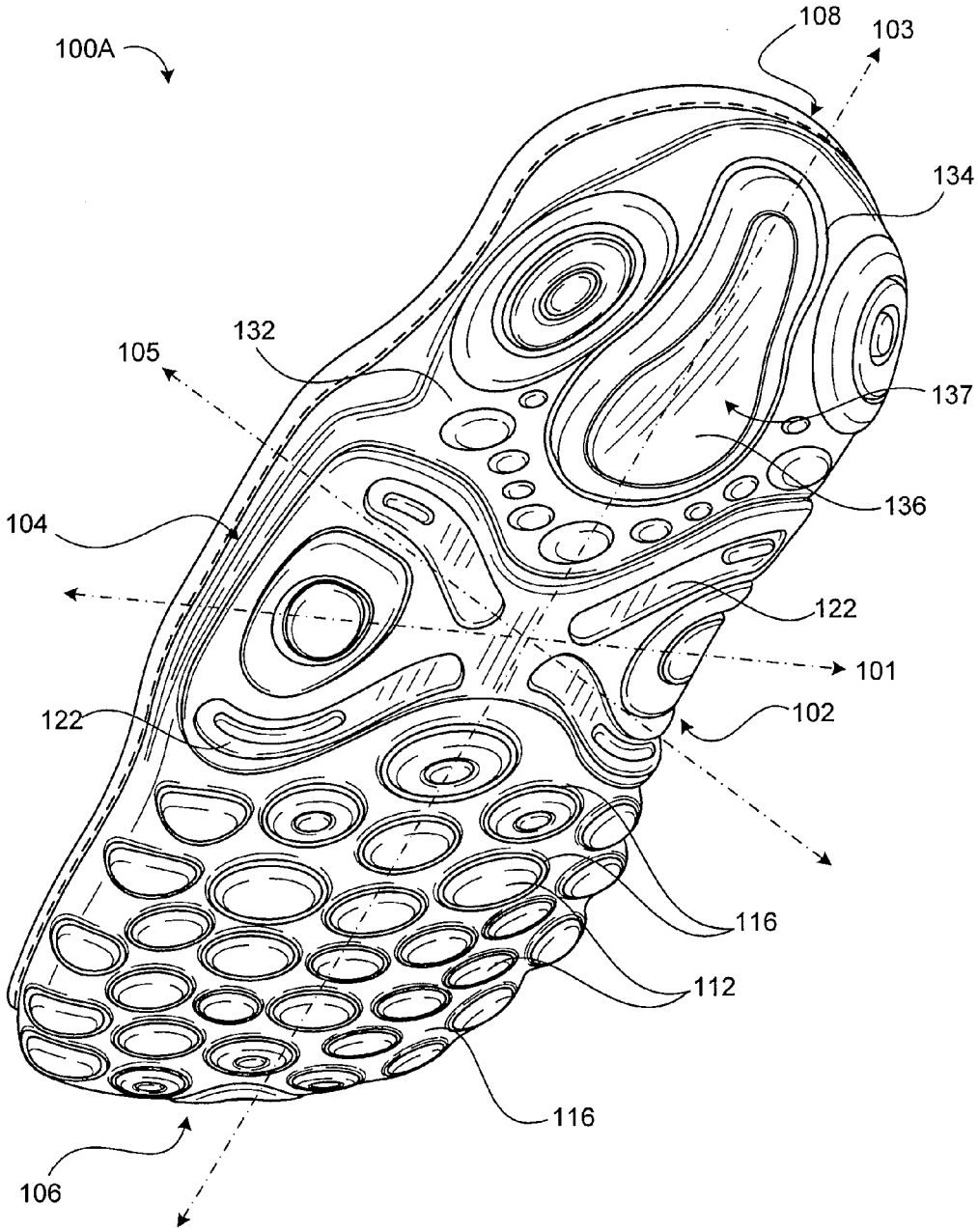
FIG. 4 is a rear, bottom perspective view of the outsole shown in FIG. 3.
Figure 5:
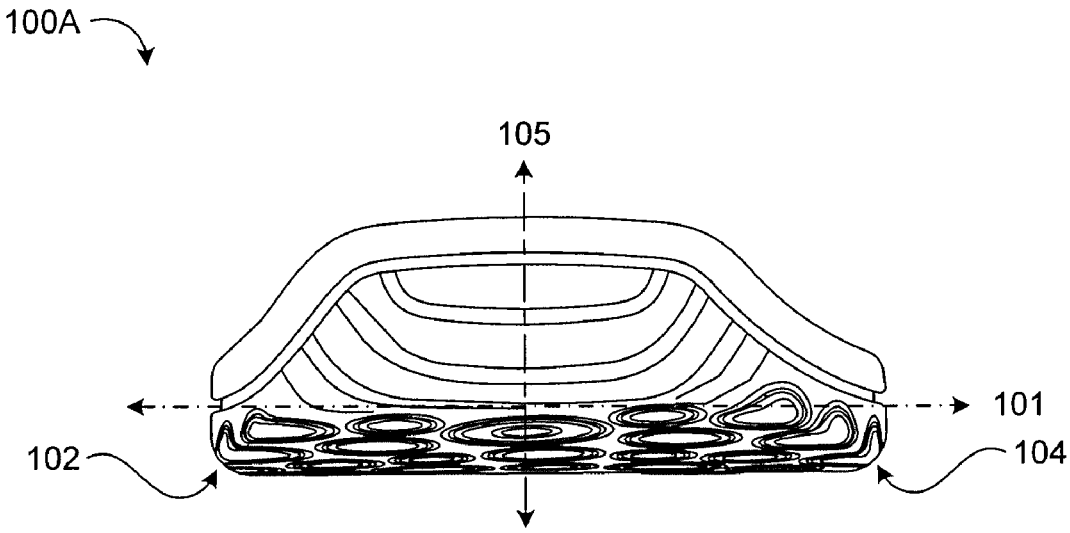
FIG. 5 is a front view of the outsole shown in FIG. 3.
Figure 6:
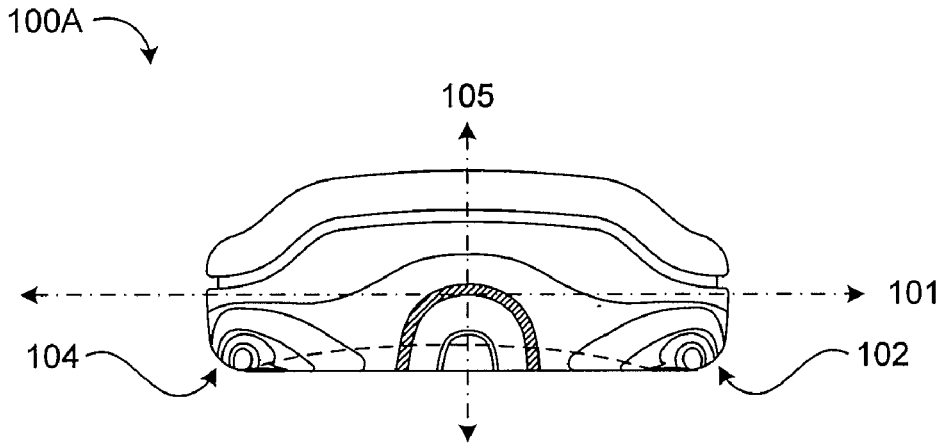
FIG. 6 is a rear view of the outsole shown in FIG. 3.
Figure 7:
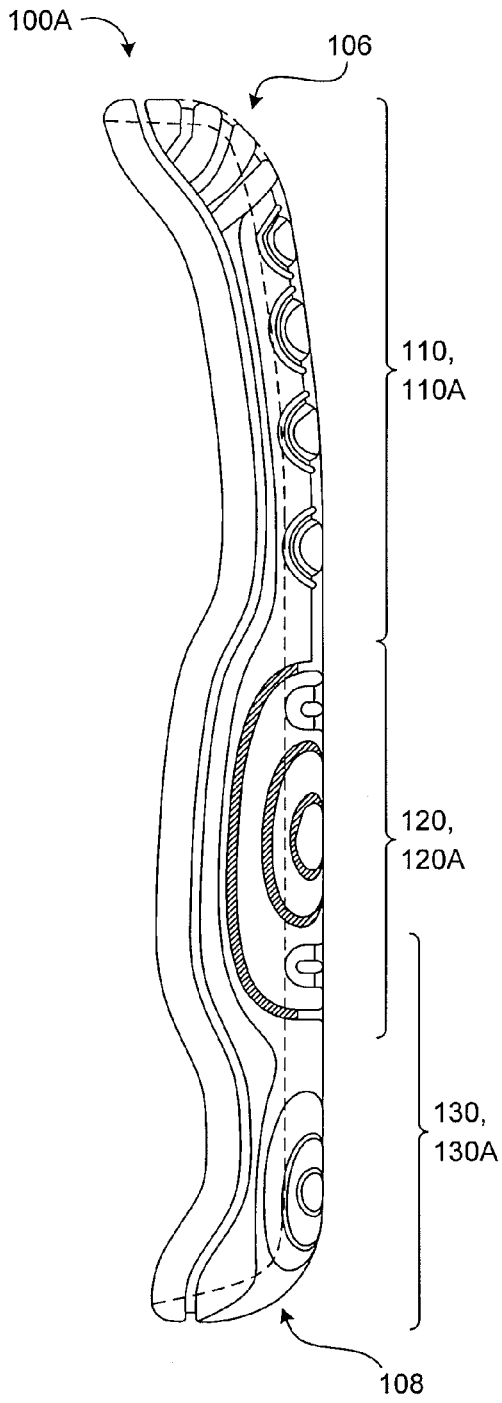
FIG. 7 is a right (inner) side view of the outsole shown in FIG. 3.
Figure 8:
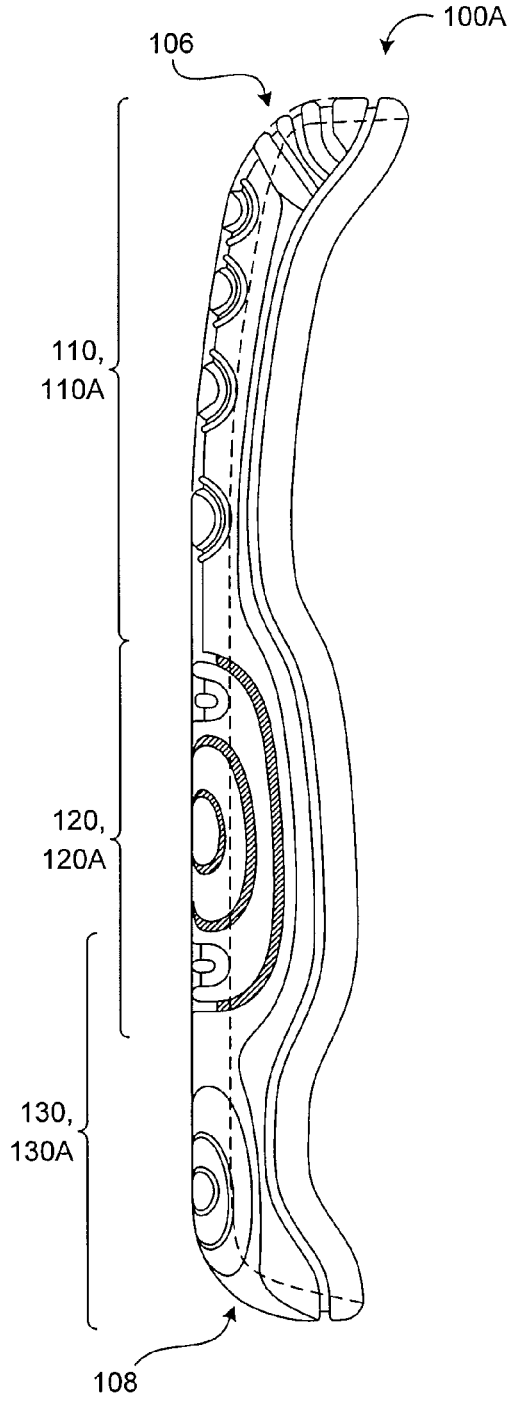
FIG. 8 is a left (outer) side view of the outsole shown in FIG. 3.
Figure 9:
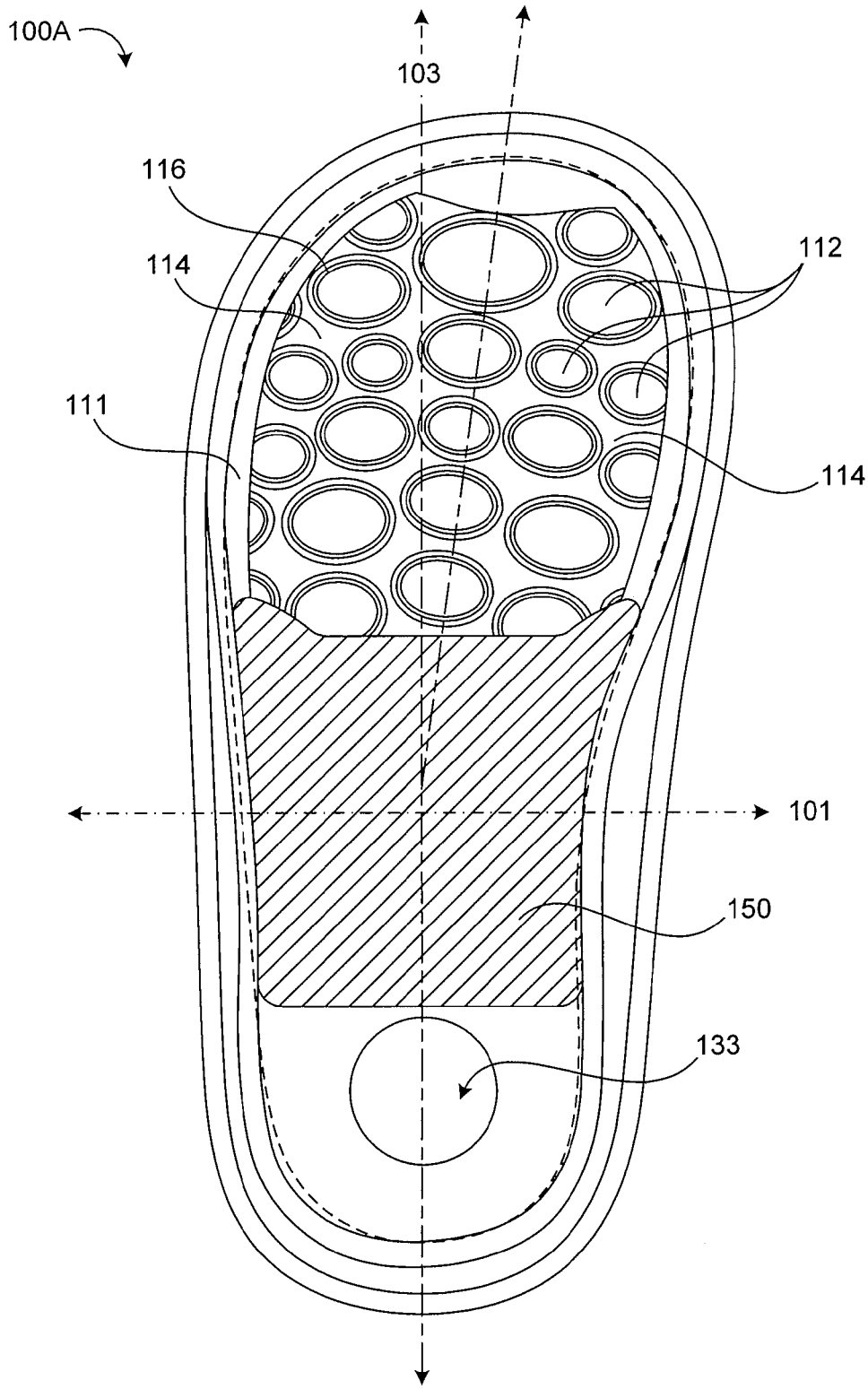
FIG. 9 is a top view of the outsole shown in FIG. 3.

FIGS. 1 and 2 illustrate an exemplary article of footwear 10. The article of footwear 10 can be configured to aid an infant in learning to walk (e.g., gait development), crawl, turn, cruise, and other activities by allowing and/or enhancing complimentary movement and proprioceptive feedback of the infant's feet. The article of footwear 10 can also be configured for use by pre-school children (e.g., 2-6 years old), post pre-school children (e.g., over 6 years of age) and adults, so as to provide complimentary movement and proprioceptive feedback which may benefit each age group in different ways. The article of footwear 10 (e.g., shoe, sandal, boot, etc.) includes an outsole 100 attached to an upper 200. The outsole 100 and upper 200 can both be dimensioned for use by an infant (e.g., 0-4 years old), pre-school children (e.g., 2-6 years old), post pre-school children (e.g., over 6 years of age) and adults. The upper 200 defines a void 205 configured to receive a user's foot. The upper 200 is stitched to the shoe outsole 100, in some implementations, providing a substantially smooth transition between the upper 200 and the outsole 100. Using stitches to secure the upper 200 to the outsole 100, rather than cement, creates a smooth (e.g. non-bulky) and supple transition between the upper 200 and the outsole 100. In other implementations, the upper 200 is bonded (e.g., adhered) to the outsole 100. Soft, premium leathers may be used in the construction of the upper 200 to provide a flexible, soft, comfortable fitting infant article of footwear 10. Other materials may be used for the upper 200 as well including textiles, non-woven materials, and any other suitable material. In preferred examples, the upper 200 includes moisture-wicking materials. The outsole 100 provides stability and comfort while allowing for or promoting complimentary movement and proprioception. The rounded edges of the outsole 100 allow a user to roll the shoe 10 over right and left lateral edge portions 102, 104, as well as toe and heel edge portions 106, 108 without catching a sharp edge that may cause the user to trip and fall.

FIGS. 3-15 illustrate one implementation of the outsole 100, 100A and FIGS. 16-28 illustrate another implementation of the outsole 100, 100B. The outsole 100, 100A, 100B includes a forefoot region 110, 110A, 110B a mid region 120, 120A, 120B and a heel region 130, 130A, 130B as shown in FIGS. 3-8 and 16-21. The forefoot region 110, 110A, 110B of the outsole 100, 100A, 100B is very flexible, pliable, and compliant, allowing complimentary movement and tactile sensation of a supporting surface through the article of footwear 10. The ability to feel the supporting surface through the article of footwear 10 allows the user to receive proprioceptive feedback of the supporting surface through the outsole 100. The proprioceptive feedback can be very beneficial for infants and toddlers learning to use while learning to walk, developing a proper gait in walking, as well as in other activities such as crawling, cruising, turning, climbing, etc.

The outsole 100, 100A, 100B defines a sagittal axis 101, a front axis 103, and a transverse axis 105. The outsole 100 is configured to provide motion control along three axes of rotation. In particular, the outsole 100 allows bending about the sagittal axis 101, substantially inhibits bending about the transverse axis 105, and provides torsional resistance about the front axis 103 (e.g., to prevent an inward twisting motion of a developing foot).

Torsion stiffness (also referred to as torsion flexibility) of the article of footwear 10 can be measured using a tensile tester connected via braided cable to a pulley/forefoot plate assembly rotating at 13.32 deg/s. Force and displacement data is collected as raw data by software at 20 Hz and converted to moment and angle in spreadsheet software. The heel region 130 is secured in place by rotating a vertically translating screw. For torsional stiffness testing, the cable rotates the pulley applying a frontal plane twisting moment to the article of footwear 10 through the forefoot plate. The forefoot region 110 of the article of footwear 10 is grounded to the forefoot plate via a horizontal clamping bar. The forefoot plate is angled in the sagittal plane to accommodate dorsiflexion in the toe rocker. For mounting shoes for testing, a piece of ⅜ inch closed cell foam is inserted in the toe box past the toe break line and another piece of ⅜ inch closed cell foam is placed under the plunger of the of the rear foot-grounding device. The shoes are pre-marked on the lateral side to indicate the forward edge of the heel and lateral location of the toe break line at 25% and 75% of the shoe length, respectively. Each shoe is centered relative to the axis of rotation of the forefoot plate, as suggested in the standard developed by ASTM for running shoes (ASTM, 1994). The heel region 130 and forefoot region 110 of the shoe 10 are grounded such that the posterior mark aligned with the front edge of the rear foot-grounding device and the forward mark is aligned with a fulcrum of applied force (e.g., the rear edge of a forefoot torsion plate in the torsional flexibility configuration or the lateral side of the angled clamping bar in the toe break flexibility configuration.) When measuring torsional flexibility, the gauge length of the tensile tester is set at zero at the position where the torsional testing platform is horizontal. The shoe is mounted in the heel region 130 first and the forefoot platform is angled in the sagittal plane to accommodate the toe break angle of the last. For each trial, the tensile tester is positioned at −5 mm and the shoe is pre-torqued in inversion manually with five pulses of 2.0 Nm, so as to pre-positioned the sample in an inverted position. The forefoot region 110 is rotated on the heel region 130 to approximately 50 degrees (e.g., an angle selected to represent the extreme of forefoot inversion in a toddler foot).

In some implementations, the outsole 100 provides a torsional resistance of at least 15 degrees/N*m, and preferably a torsional resistance of between about 15 degrees/N*m and about 75 degrees/N*m (e.g., about the front axis 103). Tables 1 and 2 below provide exemplary torsion angles, minimum torsional resistance and ranges of torsional resistance for different user groups.

TABLE 1

Torsion Flexibility For First-Walker
(Age: about 12-18 months, (e.g., Size 5 children's shoes))

| Torsion angle (Degrees) | Preferred Torsion level (°/Nm) | Range of Torsion Level (°/Nm) |
|---|---|---|
| About 10° to about 15° | About 55 | About 30 to about 75 |
| About 15° to about 20° | About 50 | About 28 to about 65 |

TABLE 2

Torsion Flexibility For Pre-School
(Age: about 4-6 years, (e.g., Size 12 children's shoes))

| Torsion Angle (Degrees) | Preferred Torsion level (°/Nm) | Range of Torsion level (°/Nm) |
|---|---|---|
| About 10° to about 15° | About 40 | About 25 to about 60 |
| About 15° to about 20° | About 35 | About 20 to about 55 |

Toe-break flexibility experiments can be performed using a tensile tester connected by a cable to the mobile end of a hinged plate. Force readings are taken continuously over a range of 0 to 50 degrees of flexing with the tensile tester operating at a speed of 500 mm/minute. The rear of the flex location on the lateral side of the shoe is defined as the point (L) which is 60% of the entire shoe length from the rear of the heel. The rear of the flex location for the medial side corresponds to the point (M) which connects to the line drawn from the point L at an angle of 20 degrees from the longitudinal axis of the shoe. The line LM defines the rear of the toe-break flex zone. The shoe is position on the testing fixture such that line LM is positioned over the stationary end of the fixture—rear of the shoe sits on the stationary portion of the fixture, while forefoot of the shoe sits on the hinged plate. The shoe is clamped onto the stationary portion of fixture 10 mm behind line LM.

Relatively greater flexibility of the article of footwear 10, particularly the outsole 100, about the sagittal axis 101 increases ground contact of the outsole 100 for increased stimulation (e.g., proprioceptive learning) as the user proceeds forward over the shoe 10. In some examples, the forefoot region 110, 110A, 110B includes one or more portions (e.g., a base portion 114 and a flex portion 116, as will be described later) having a thickness thinner than thicknesses of the mid and heel regions 120, 130 to facilitate flexibility and bending of the outsole 100, 100A, 100B and shoe 10 about the sagittal axis 101. In some examples, when the outsole 100 is held stationary in the heel region 130, the forefoot region 110 is allowed to bend or deflect about the sagittal axis 101 to a 45 degree angle when a force of between about 0.5 kg to about 3.5 kg is applied to an intersection of the forefoot region 110 and the mid region 120. Table 3 and table 4 provide exemplary flexibility values for different user groups.

TABLE 3

| Toe Break Flexibility For First-Walker (Age 12-18 months, Size 5 children's shoes) | | |
|---|---|---|
| Flex Angle (Degrees) | Preferred Flexibility Range (kg) | Maximum Flexibility Limit (kg) |
| 45° | About 1.0 to about 2.0 | About 2.5 |

TABLE 4

| Toe Break Flexibility For Pre-School (Age 4-6 years, Size 12 children's shoes) | | |
|---|---|---|
| Flex Angle (Degrees) | Preferred Flexibility Range (kg) | Maximum Flexibility Limit (kg) |
| 45° | About 1.0 to about 2.5 | About 3.0 |

The article of footwear 10 has a transverse stiffness that allows the user to bend the article of footwear 10 while moving, so as to provide proprioceptive feedback. When the shoe 10 is clamped at the intersection of the heel region 130 and the mid region 120, and a force of about 5 kg is applied to the intersection of the forefoot region 110 and the mid region 120, the level of deflection at the mid-forefoot intersection is less than about 5 mm—in both lateral and medial directions. In other words, the forefoot region 110 can deflect less than about 5 mm about the transverse axis 105 away from the front axis 103 when a force of about 5 kg is applied to an intersection of the forefoot region 110 and the mid region 120.

Figure 10:
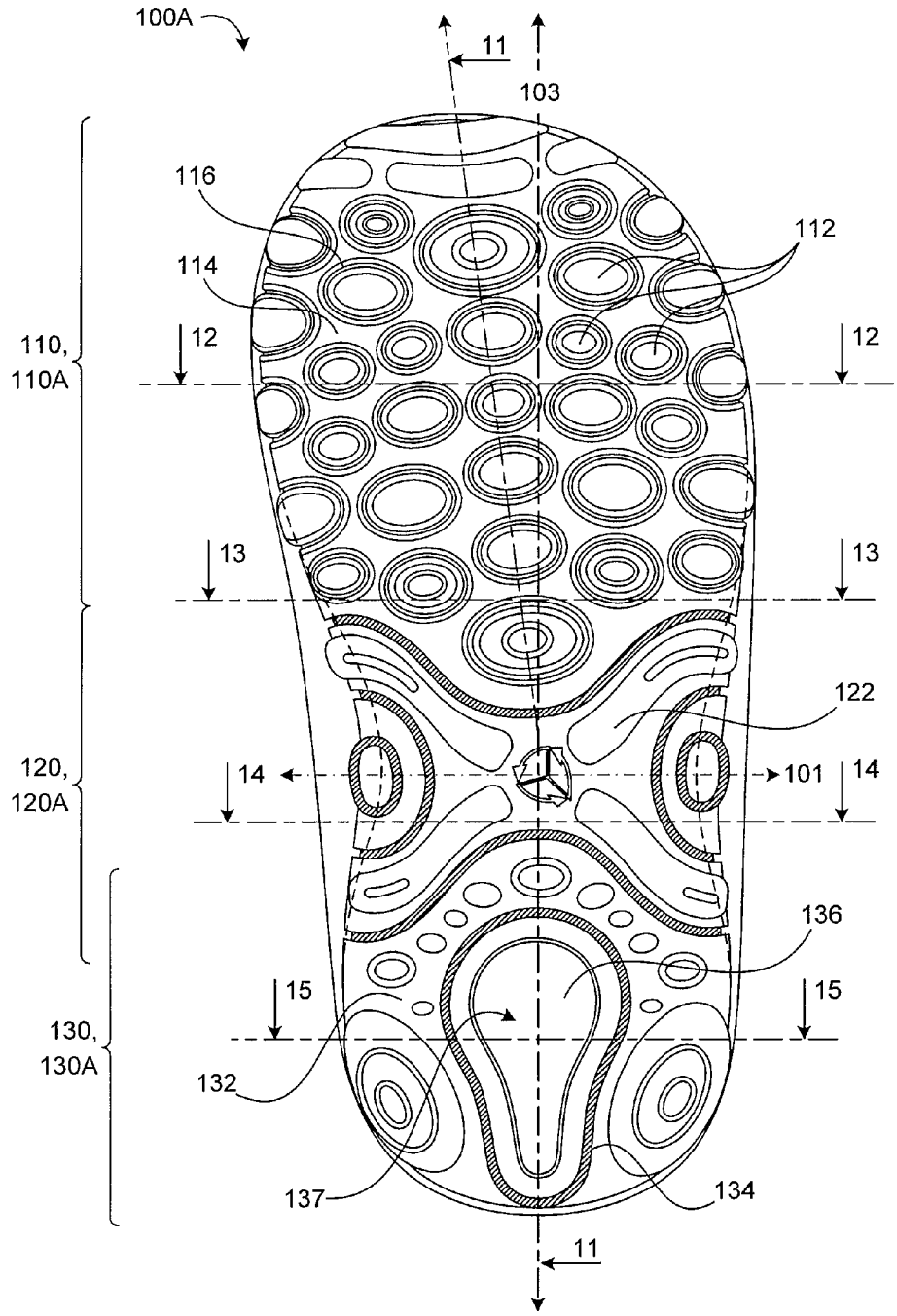
FIG. 10 is a bottom view of the outsole shown in FIG. 3.
Figure 23:
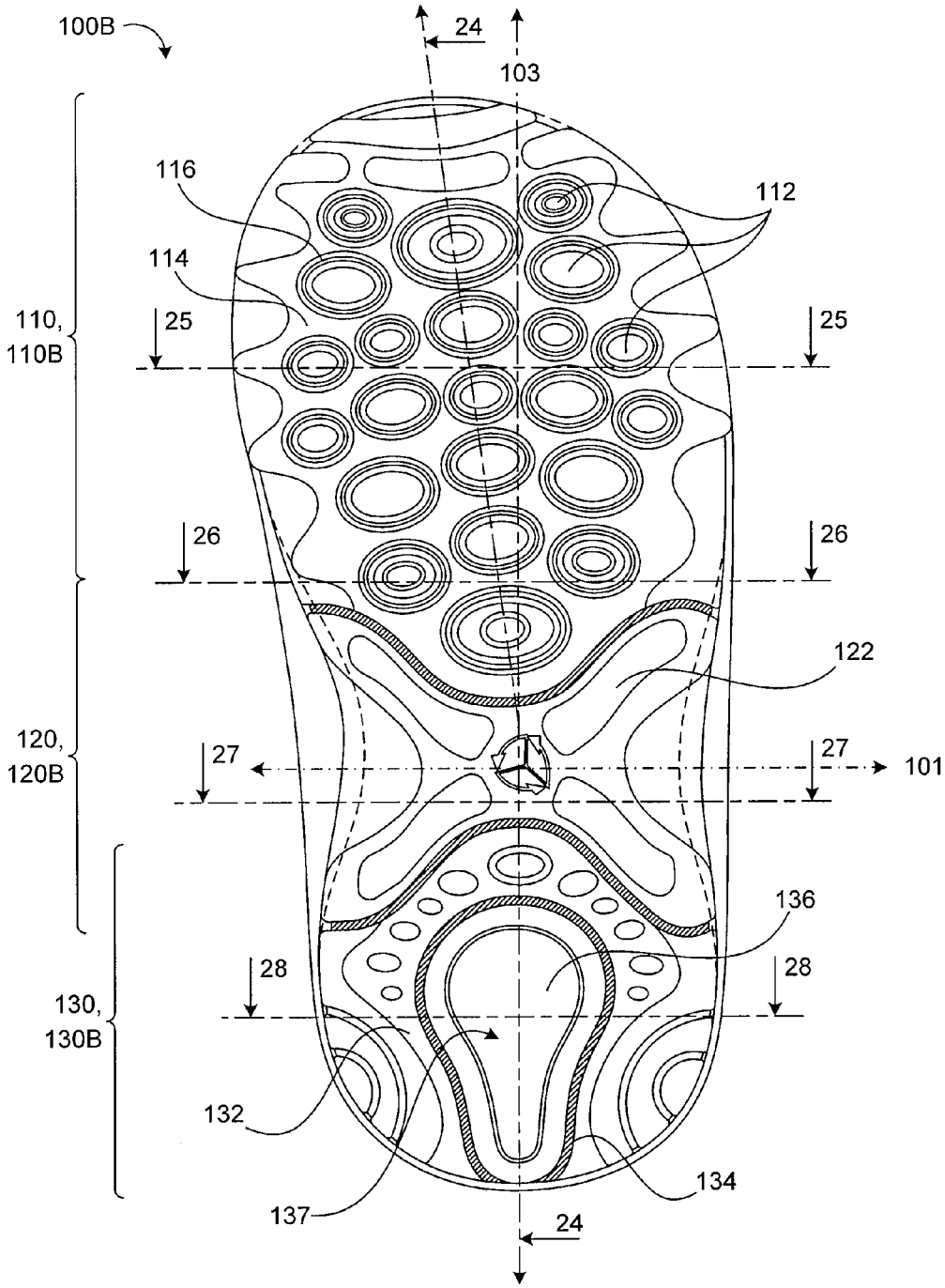
FIG. 23 is a bottom view of the outsole shown in FIG. 16.

Typical shoes include a relatively thick outsole and foot bed that mask, minimize, and/or unify ground contact forces and surface contours experienced by the user's foot. The outsole 100 is configured to allow the user to experience the contours of the supporting surface and localized forces across the outsole 100, particularly in the forefoot region 110 (e.g., to aid development of a proper gait and/or to feel the ground surface for balancing while performing some activity). Referring to FIGS. 10 and 23, the forefoot region 110, 110A, 110B of the outsole 100, 100A, 100B includes one or more ground contact pads 112 configured to move with respect to one another or a common base portion to conform to the contours of a supporting surface. The ground contact pads 112 translate forces incurred by the ground contact pads 112 to the user's foot, thereby allowing the user to experience relatively greater proprioceptive feedback from his/her foot. For example, the ground contact pads 112 allow the user to feel the distributed and localized forces across the foot, particularly in the forefoot region 110, 110A, 110B of the outsole 100, 100A, 100B. The ground contact pads 112 are shown as generally elliptical in shape, but may be of any shape (e.g., circular, rectangular, polygonal, star, etc.), and of various sizes and thicknesses. Relatively larger ground contact pads 112 may be positioned under locations of a received foot that generally experience larger impact forces or contact frequency (e.g., under the ball of the foot), while relatively smaller ground contact pads 112 may be positioned under areas of the foot that experience relatively smaller impact forces or less contract frequency, therefore providing localized load points for sensory feedback of the foot.

Referring to FIGS. 9-11 and 22-24, the forefoot region 110, 110A, 110B of the outsole 100, 100A, 100B includes a base portion 114 for the ground contact pads 112. The ground contact pads 112 are connected to the base portion 114 in a manner that allows each ground contact pad 112 to move relative to one another substantially independently, and in some examples, relative to the base portion 114. In preferred examples, the ground contact pads 112 can move in any direction (e.g., as the forefoot region 110 bends, twists, etc.) to translate localized forces and sensations to the user's foot. In some implementations, a flex portion 116 connects each ground contact pad 112 to the base portion 114 and is configured to allow the ground contact pad 112 to move relative to the base portion 114.

In some implementations, the proprioceptive feedback of the ground surface to the user's foot is generally provided through the ground contact pad pads 112, the multi-directional flexibility of the outsole 100, enhanced matched foot ground contact, a complimentary foot bed 300 to allow sensing of the ground contact pad pads 112, and shaping of the shoe 10 to better match the user's foot. The ground contact pad pads 112 function to provide proprioceptive feedback through the bottom portion as well as the top portion of the outsole 100. The shape of the ground contact pad pads 112 can vary in top and bottom, and do not have to be the same on top and bottom. Furthermore, the ground contact pad pads 112 do not necessarily have to fully align on the top and bottom of the outsole 100. The ground contact pad pads 112 can be made of different materials and different durometers. The ground contact pad pads 112 can also be integrated into a foot bed 300 of the shoe 10.

In some implementations, the forefoot region 110, 110A, 110B comprises multiple materials of different Young's modulii of elasticity and/or durometers. In some examples, the flex portion 116 comprises an elastic material having a Young's modulus of elasticity and/or durometer less than the other portions of the forefoot region 110, 110A, 110B. As a result, the flex portion 116 elastically deforms relatively more easily (e.g., under lower forces) than both the ground contact pad 112 and the base portion 114, thus allowing the ground contact pad 112 to move relative to the base portion 114. Similarly, the ground contact pad 112 may have a Young's modulus of elasticity and/or durometer greater than the base portion 114 so that the ground contact pad 112 maintains a substantially uniform shape to transfer ground contact forces.

In the examples shown in FIGS. 9-14 and 22-27, the base portion 114 has a thickness T1 less than a thickness T2 of the ground contact pads 112 and a thickness T3 of the mid region 120 to provide greater flexibility in the forefoot region 110 as compared to the mid region 120 and optionally the heel region 130. The flex portion 116 at least partially circumscribes each ground contact pad 112 in the base portion 114. In some examples, the flex portion 116 has a thickness T4 less than the base portion thickness T1 and the ground contact pad thickness T2, allowing the flex portion 116 to bend more easily than the other portions of the forefoot region 110. In examples where the flex portion 116 comprises an elastic material, such as rubber, the relatively thinner flex portion 116 elastically deforms more easily than the other portions of the forefoot region 110 for allowing ground contact pad movement.

Figure 11:
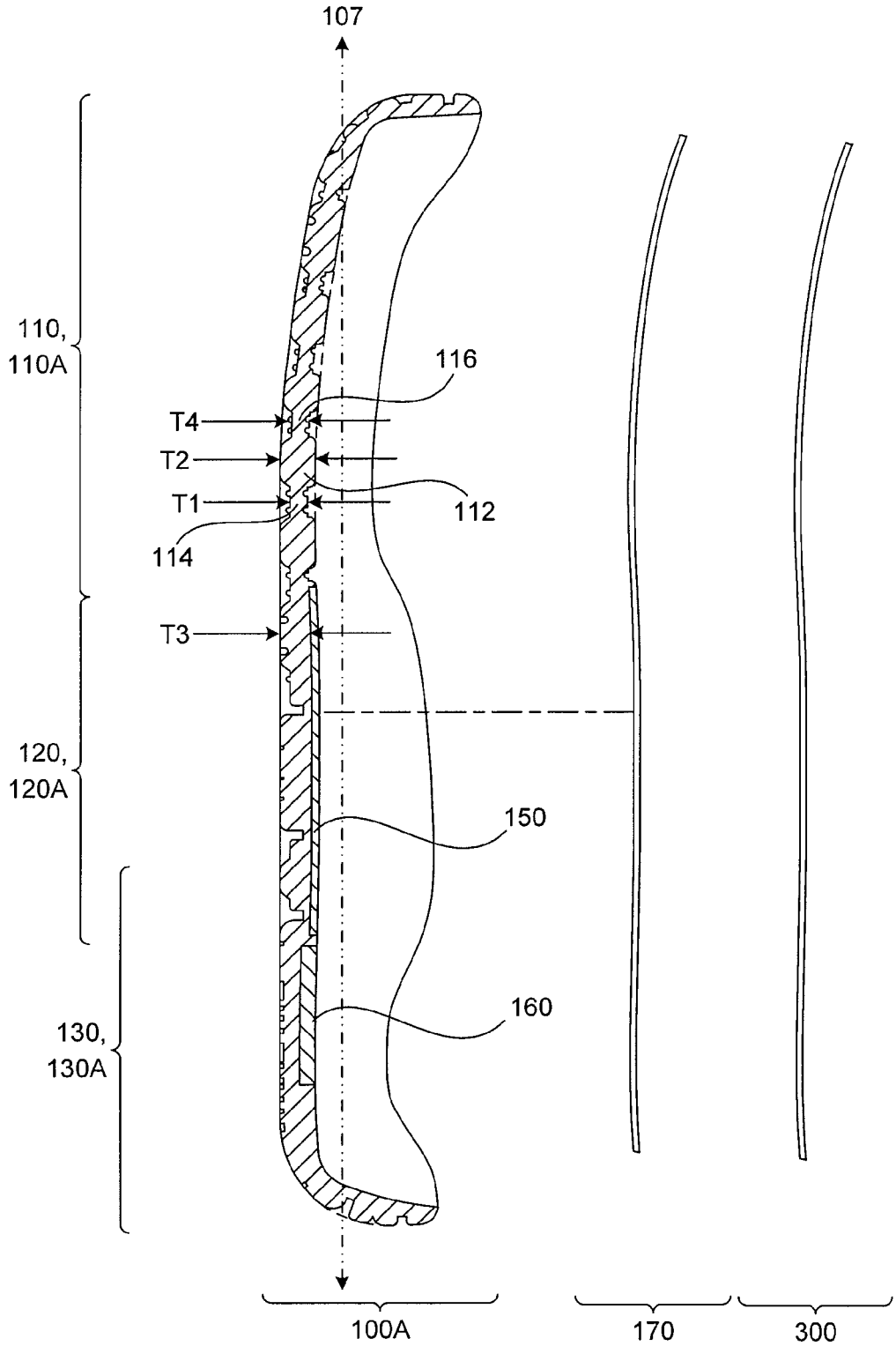
FIG. 11 is a side section view of the outsole shown in FIG. 10 along line 11-11.
Figure 12:
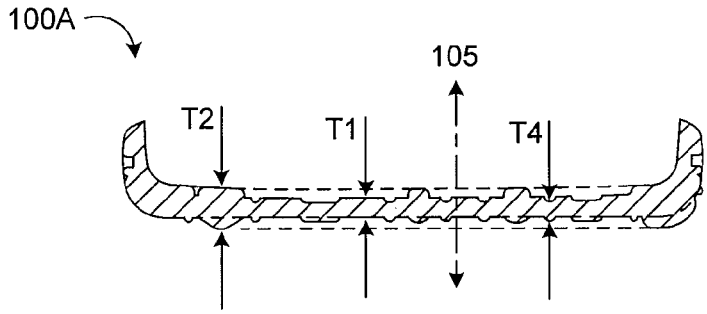
FIG. 12 is an end section view of the outsole shown in FIG. 10 along line 12-12.
Figure 13:
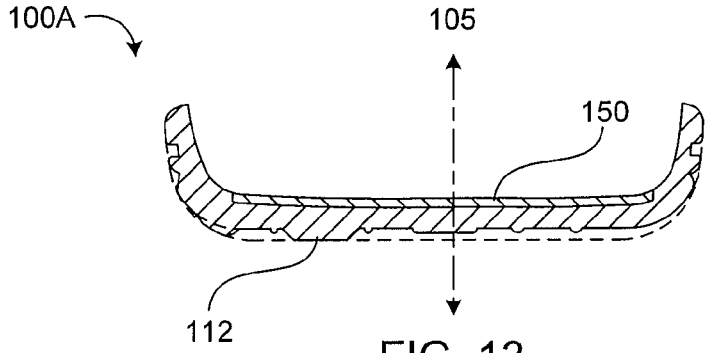
FIG. 13 is an end section view of the outsole shown in FIG. 10 along line 13-13.
Figure 14:
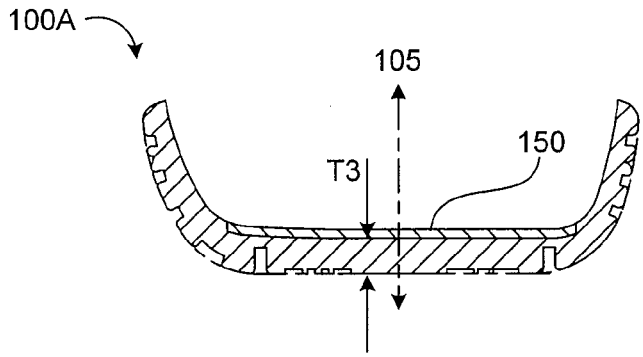
FIG. 14 is an end section view of the outsole shown in FIG. 10 along line 14-14.
Figure 15:
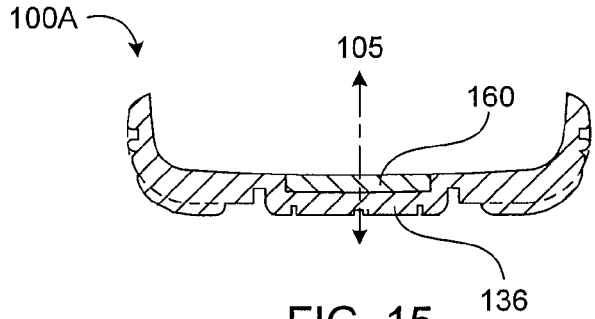
FIG. 15 is an end section view of the outsole shown in FIG. 10 along line 15-15.
Figure 16:
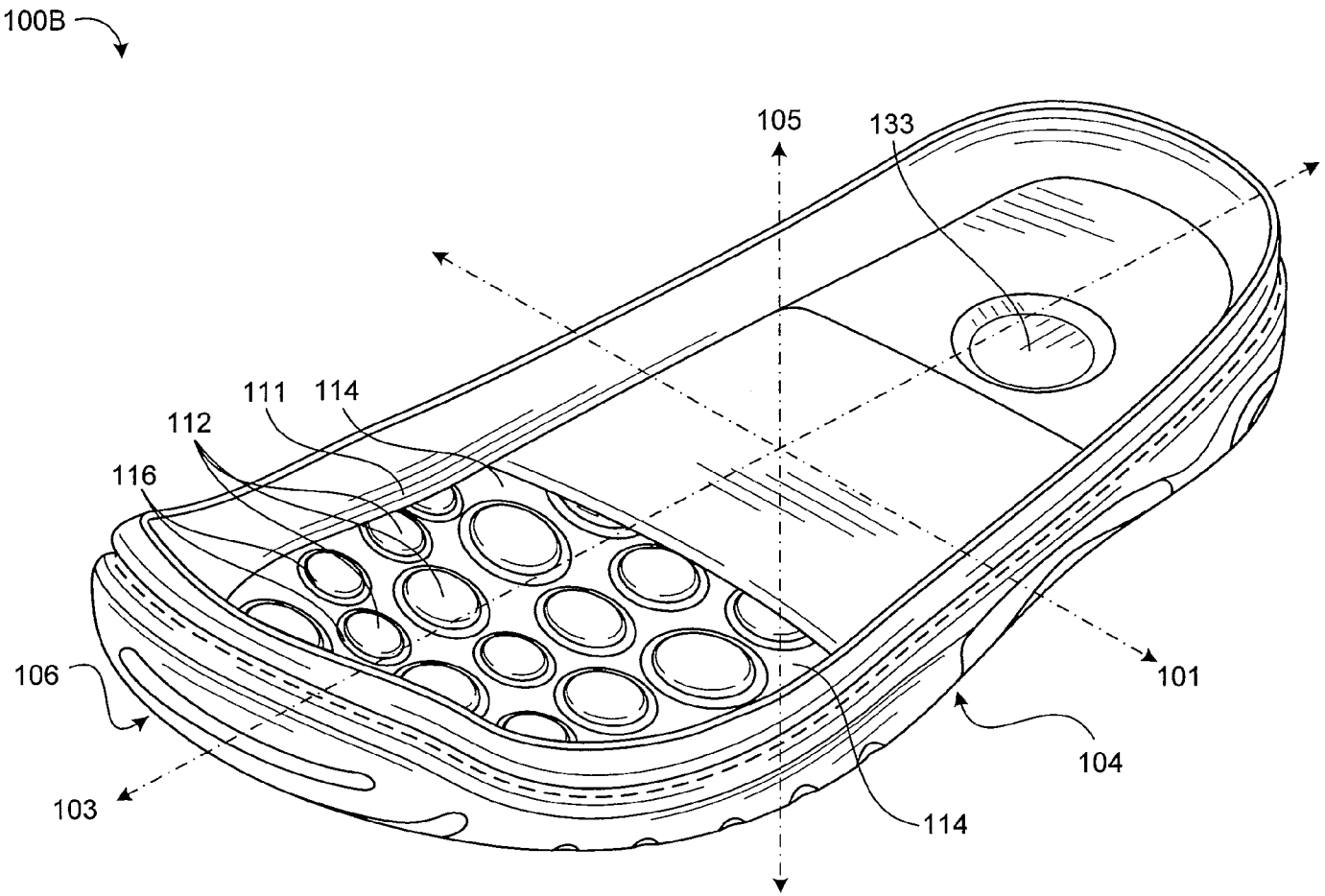
FIG. 16 is a top, front perspective view of an outsole for an article of footwear.
Figure 17:
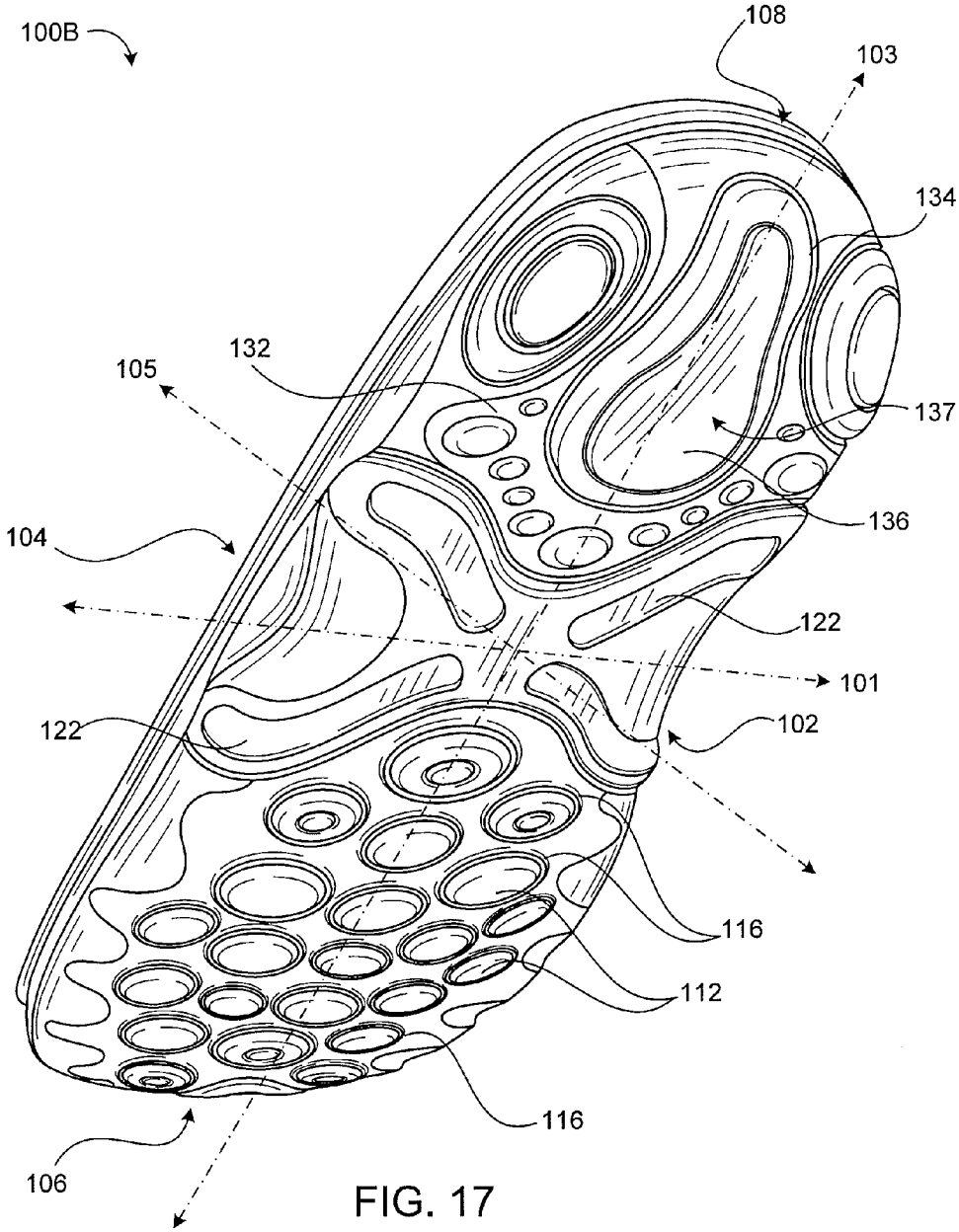
FIG. 17 is a bottom, rear perspective view of the outsole shown in FIG. 16.
Figure 18:
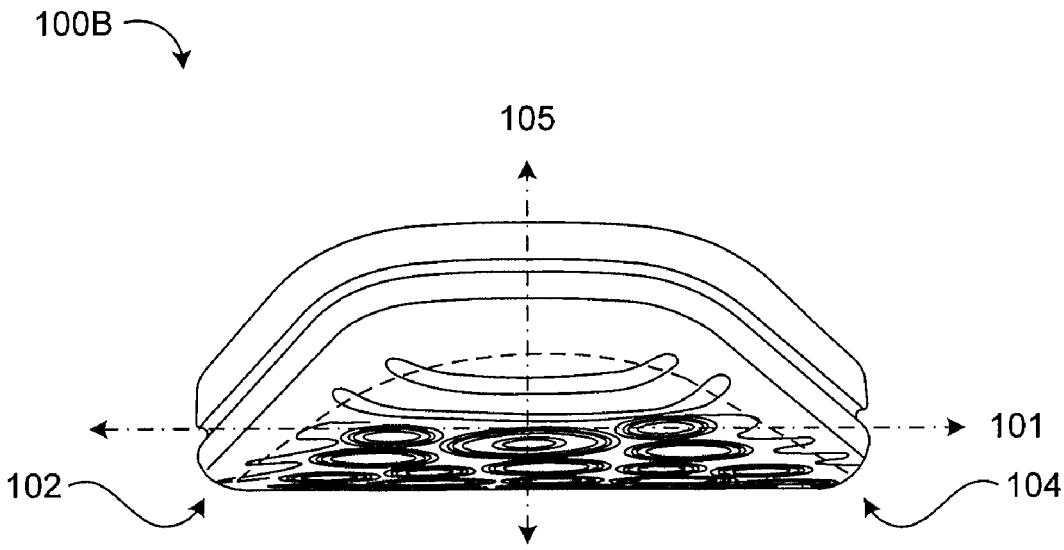
FIG. 18 is a front view of the outsole shown in FIG. 16.
Figure 19:
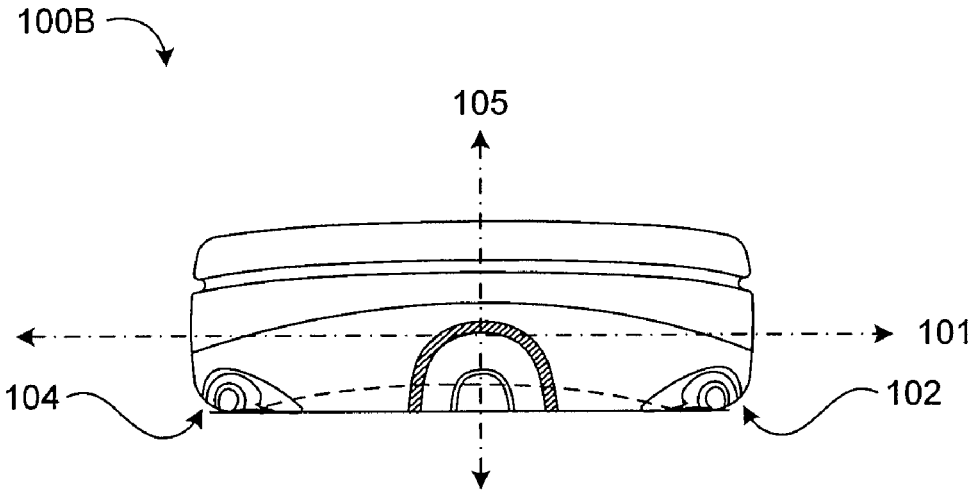
FIG. 19 is a rear view of the outsole shown in FIG. 16.
Figure 20:
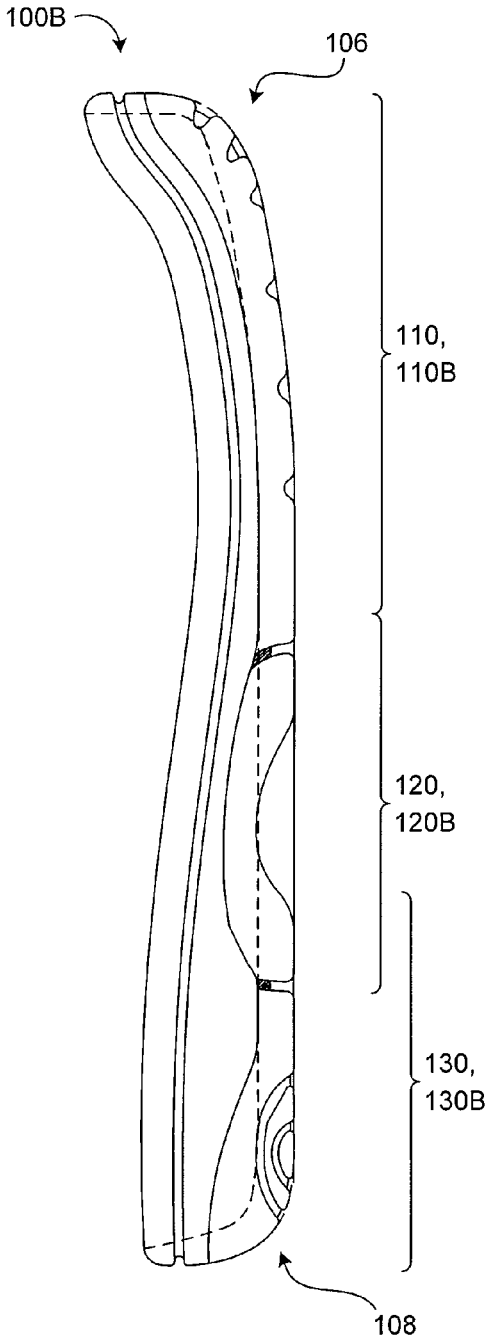
FIG. 20 is a right (inner) side view of the outsole shown in FIG. 16.
Figure 21:
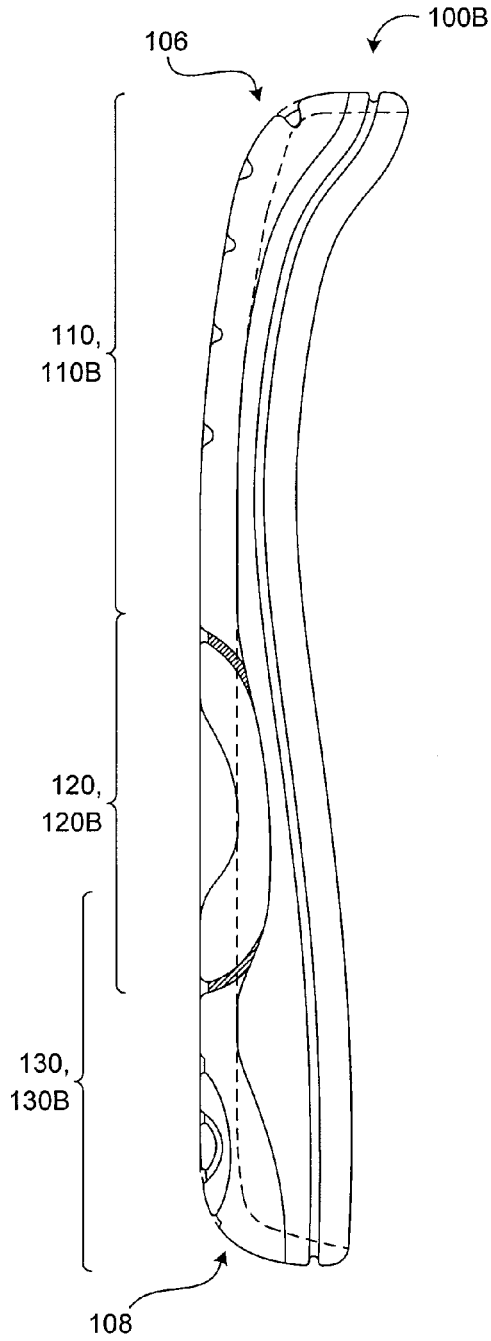
FIG. 21 is a left (outer) side view of the outsole shown in FIG. 16.
Figure 22:
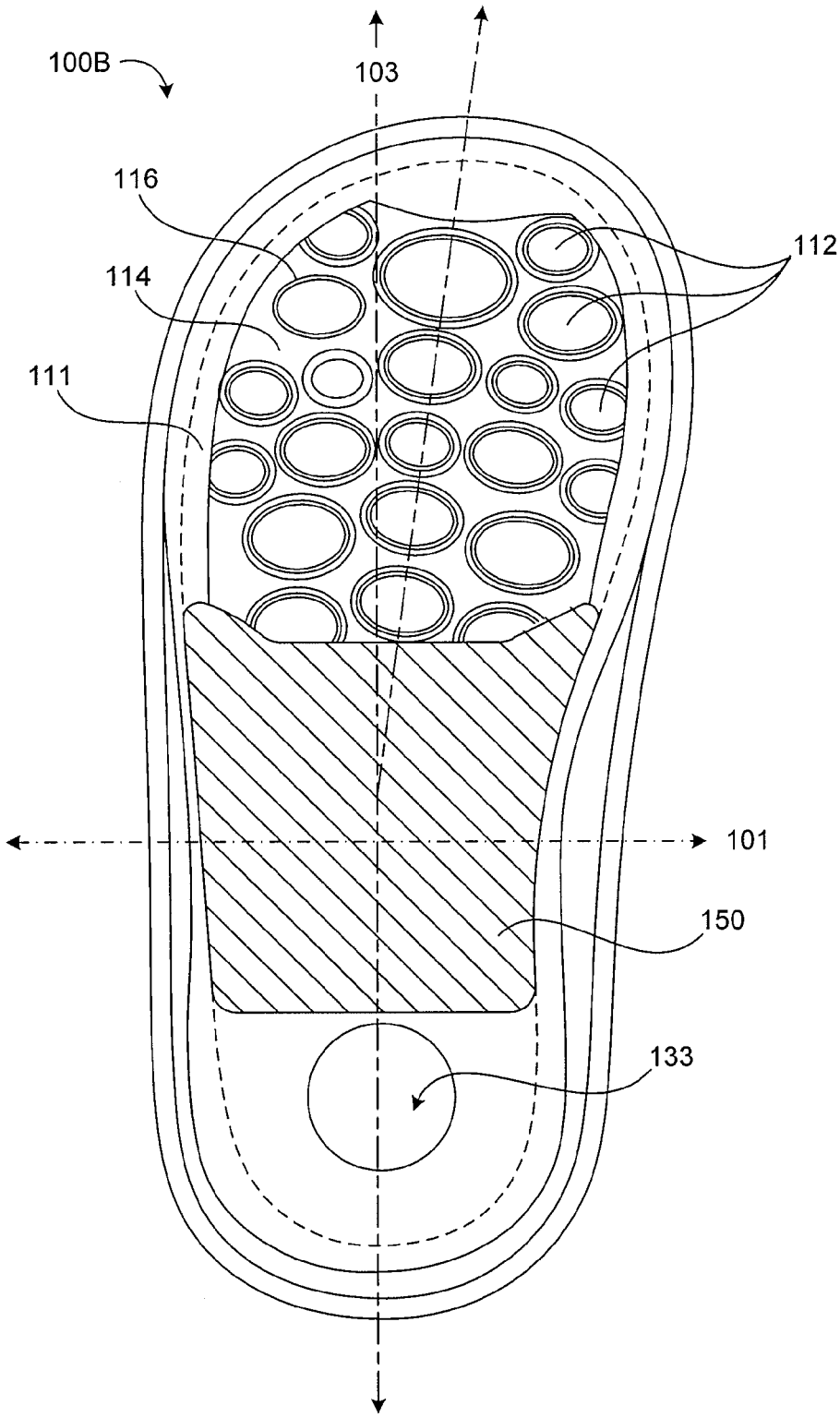
FIG. 22 is a top view of the outsole shown in FIG. 16.
Figure 24:
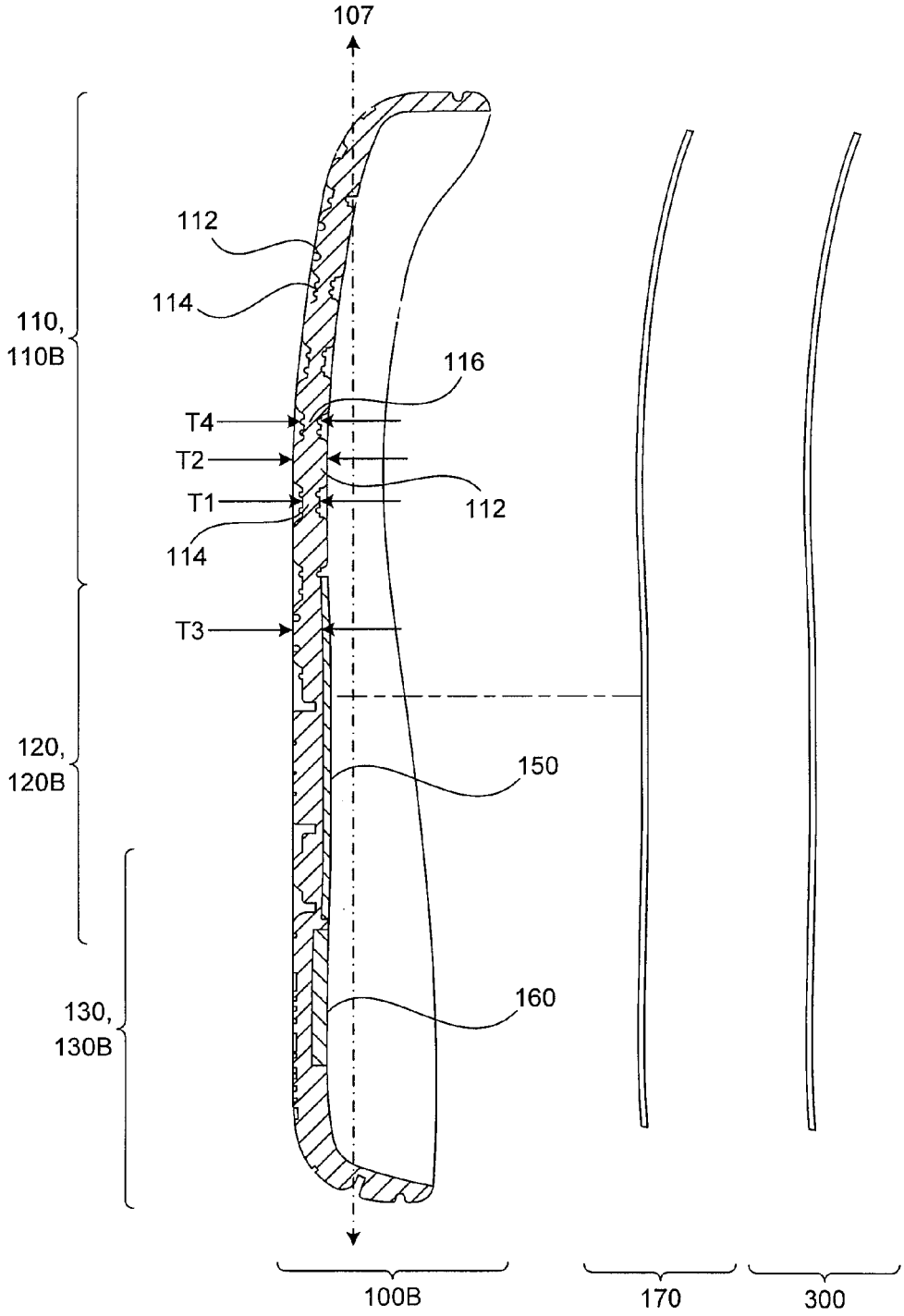
FIG. 24 is a side section view of the outsole shown in FIG. 23 along line 24-24.
Figure 25:
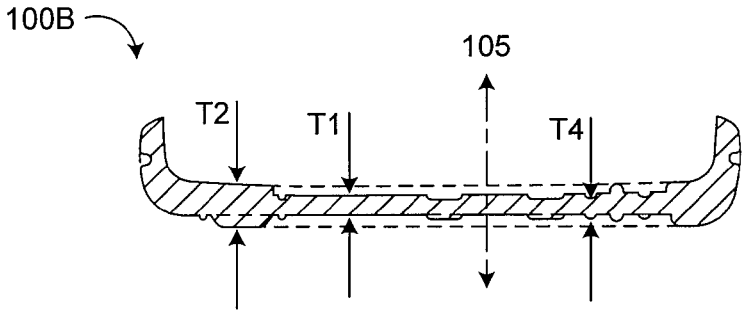
FIG. 25 is a side section view of the outsole shown in FIG. 23 along line 25-25.
Figure 26:
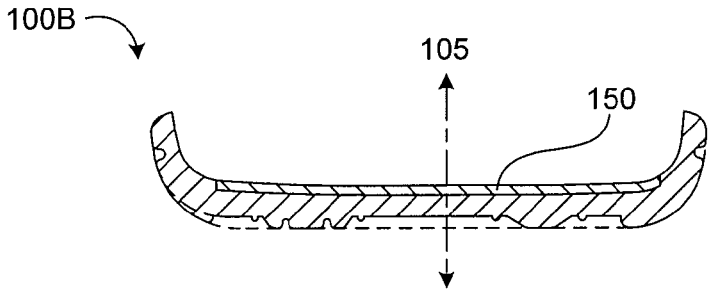
FIG. 26 is an end section view of the outsole shown in FIG. 23 along line 26-26.
Figure 27:
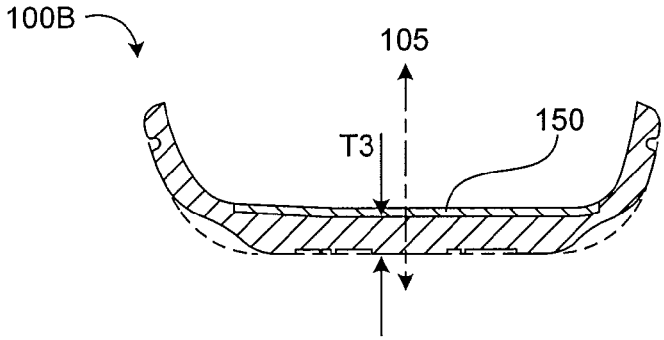
FIG. 27 is an end section view of the outsole shown in FIG. 23 along line 27-27.
Figure 28:
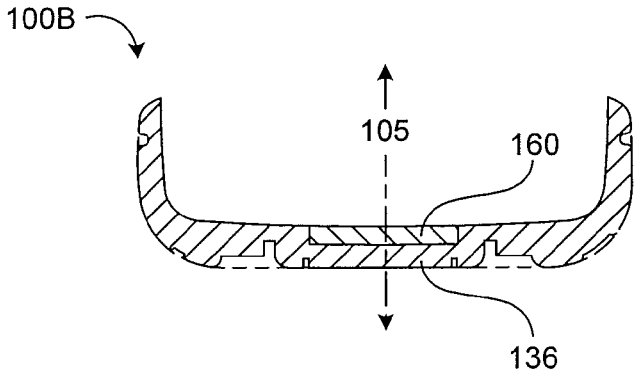
FIG. 28 is an end section view of the outsole shown in FIG. 23 along line 28-28.
Figure 29:
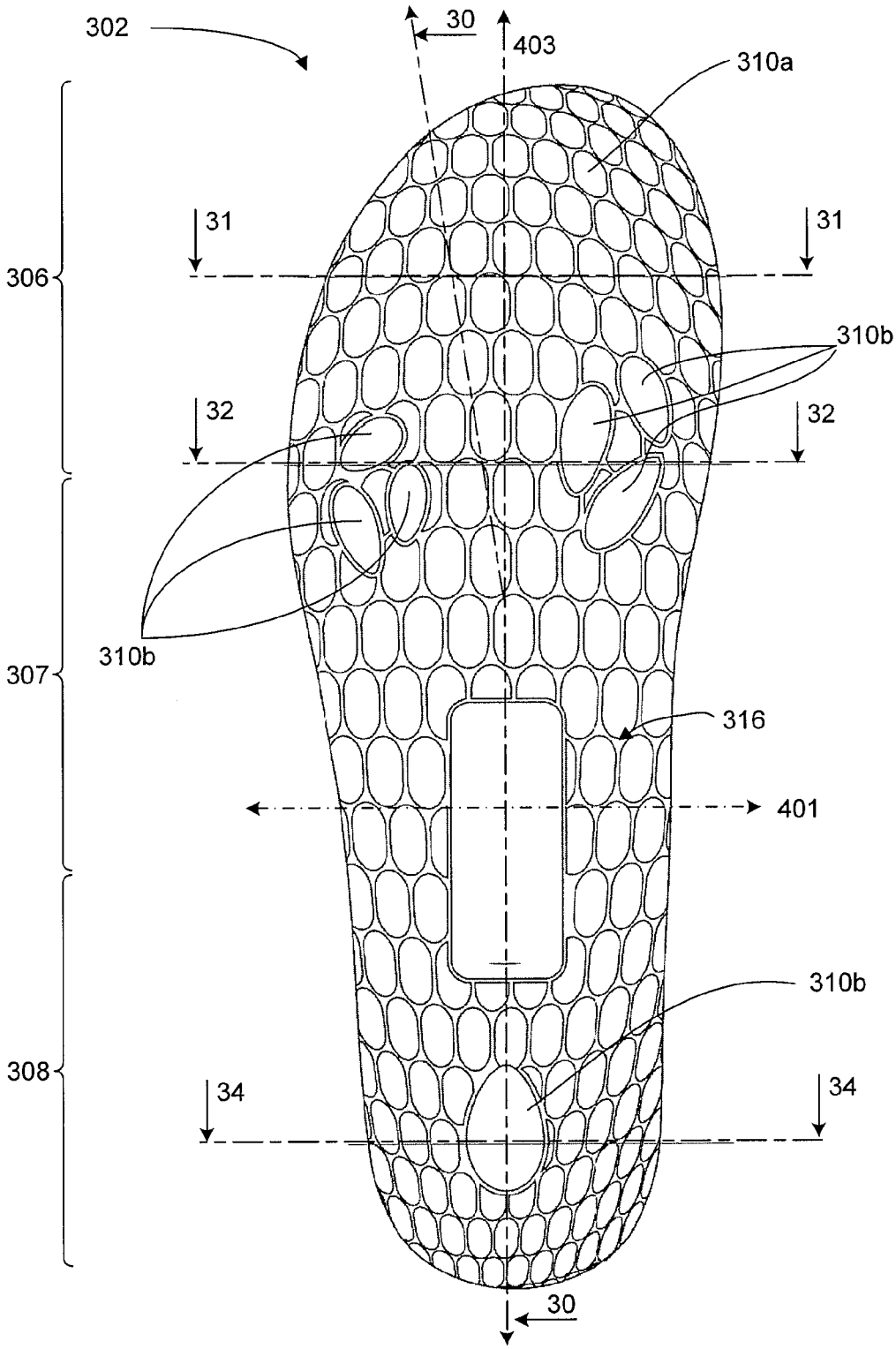
FIG. 29 is a top view of a footbed for an article of footwear.
Figure 30:
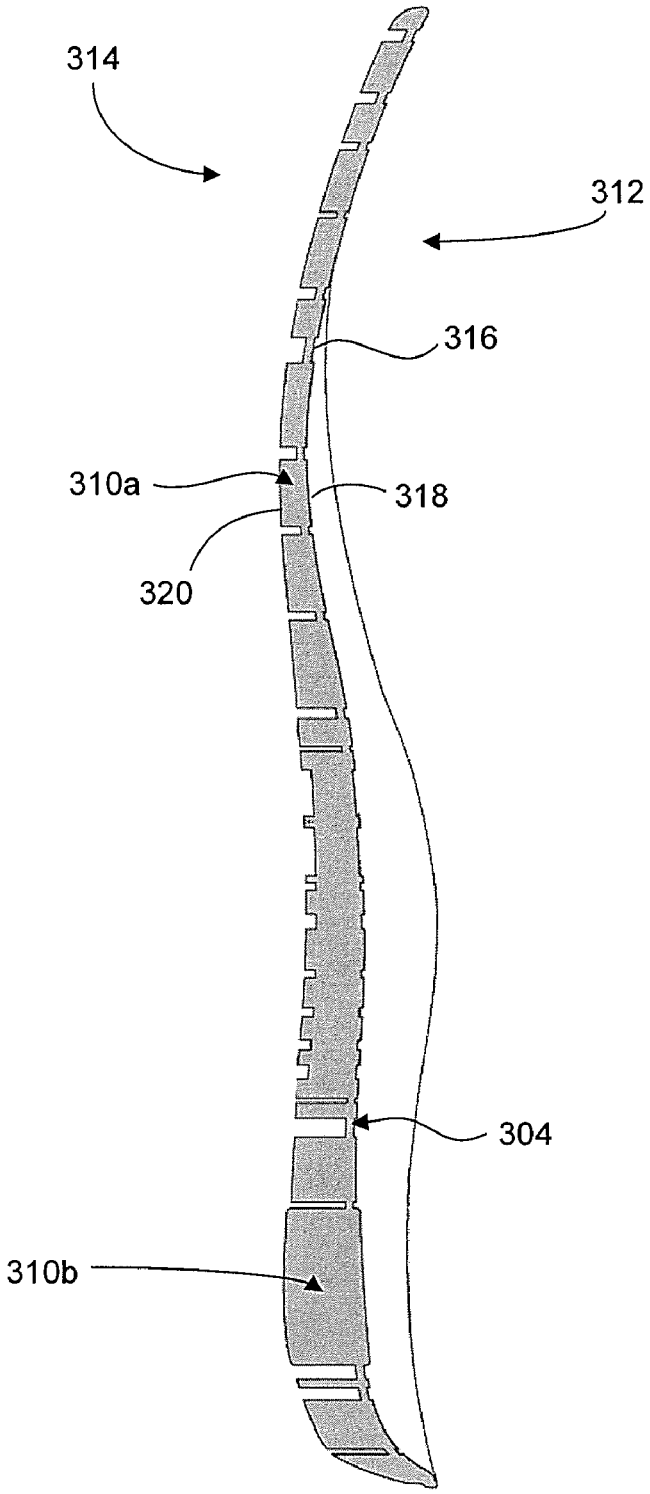
FIG. 30 is a side section view of the footbed shown in FIG. 29 along line 30-30.
Figure 31:
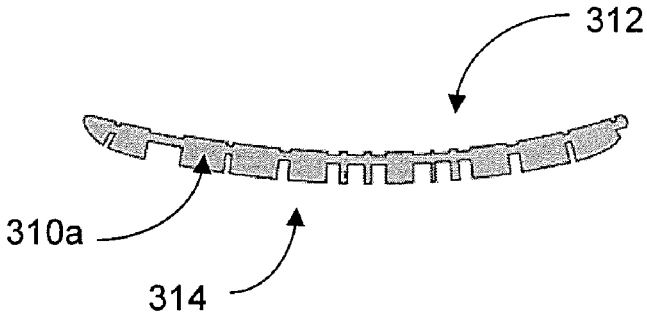
FIG. 31 is an end section view of the footbed shown in FIG. 29 along line 31-31.
Figure 32:
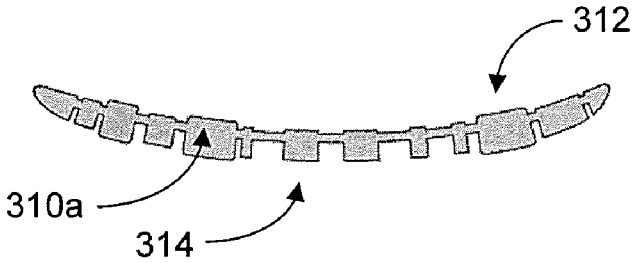
FIG. 32 is an end section view of the footbed shown in FIG. 29 along line 32-32.
Figure 33:
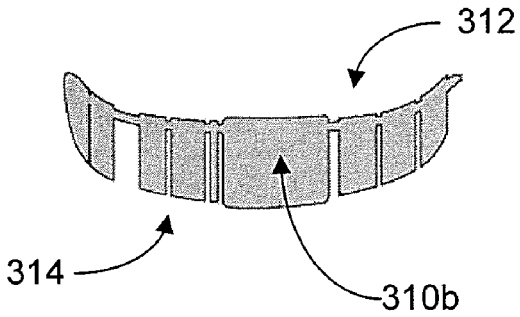
FIG. 33 is an end section view of the footbed shown in FIG. 29 along line 33-33.

Referring to FIGS. 11 and 24, in some implementations, the flex portion 116 defines a substantially corrugated shape (e.g., having one or more undulations) to facilitate bending and flexing thereof and movement of the associated ground contact pad 112. The undulation(s) of the flex portion 116 aid vertical movement of the ground contact pad 112 with respect to the base portion 114. In some examples, the flex portion comprises a groove or recess defined by the base portion 114.

In some examples, the heel region 130, 130A, 130B of the outsole 100 defines a heel cavity 133 for receiving a heel insert 160 to provide additional cushioning under the heel of the infant's foot. The heel insert 160 may comprise a polyolefin, such as an ethylene-vinyl-acetate copolymer (EVA)

and have a durometer softer than the heel region 130, 130A, 130B of the outsole 100. In some implementations, the heel insert 160 has a durometer of between about 25 Asker C and about 55 Asker C.

The outsole 100 may include multiple materials of different durometers. In some examples, the forefoot region 110 has a durometer of between about 40 Shore A and about 70 Shore A (preferably between about 47 Shore A and about 60 Shore A), the mid region 120 has a durometer of between about 40 Shore A and about 80 Shore A (preferably between about 45 Shore A and about 75 Shore A), and the heel region 130 has a durometer of between about 40 Shore A and about 70 Shore A (preferably between about 47 Shore A and about 60 Shore A).

Referring to the examples shown in FIGS. 10 and 23, the heel region 130, 130A, 130B of the shoe outsole 100, 100A, 100B includes an outer heel member 132 having an inner heel region 134, and an inner heel member 136 located in the inner heel region 134. The inner member 136 has a ground contacting surface 137 and a relatively lower durometer than the outer heel member 132. The outer heel member 132 may have a durometer of between about 40 Shore A and about 70 Shore A (preferably between about 47 Shore A and about 60 Shore A). The inner member 136 may have a durometer of between about 30 Shore A and about 60 Shore A (preferably between about 40 Shore A and about 55 Shore A). The inner heel member 136 is positioned and dimensioned to fit under a user's heel during use of the article of footwear 10. In the examples shown, the inner heel member 136 substantially defines a key shape. The relatively softer durometer of the inner heel member 136 (relative to the rest of the outsole 100) in combination with the heel insert 160 provides cushioning for the infant's heel while walking.

Referring again to FIGS. 9, 11, 22, and 24, in some implementations, the outsole 100 includes a shank 150 disposed substantially in the mid region 120. The shank 150 may include a material, such as plastic, that provides torsional resistance about the front axis 103 and/or the transverse axis 105. In some examples, the shank 150 is a sheet of thermoplastic polyurethane (TPU), glass filled nylon, rubber sheet, foam sheet, or combination thereof, and has a thickness of between about 0.5 mm and about 2 mm. The torsional resistance provided by the shank 150 decreases twisting of a user's foot while learning to walk.

Referring again to FIGS. 10 and 23, the mid region 120, 120A, 120B of the shoe outsole 100, 100A, 100B may be configured to provide resistance to torsion about the front axis 103 and the transverse axis 105. In some implementations, the mid region 120 has a torsional stiffness of between about 15 degrees/N*m and about 75 degrees/N*m. The mid region 120, 120A, 120B may have a torsional stiffness greater than the forefoot region 110 and the heel region 130. The mid region 120 may include the outsole 110 and a torsion control portion 122 (e.g., reinforcing material), which together provide the desired torsional stiffness of the mid region 120. The torsion control portion 122 may comprise a material having a durometer of between about 45 Shore A and about 75 Shore A. In some examples, the torsion control portion 122 defines a substantially cruciform shape from a bottom view of the outsole 100, which impedes flexing of the outsole 100 about the sagittal axis 101 and the front axis 103, while substantially inhibiting flexing of the outsole 100 about the transverse axis 105. The torsion control portion 122 may be configured to provide a torsion resistance about the front axis 103 of between about 15 degrees/N*m and about 75 degrees/N*m and/or a bending stiffness about the transverse axis 105 of about 5 in*lbs per 5 mm of displacement. Different amounts of torsional resistance and bending stiffness can be achieved for the torsion control portion 122 by a combination (e.g., adhered layers) or composite of different materials.

In some examples, the article of footwear 10 has a transverse stiffness such that when the article of footwear 10 is clamped at the intersection of the heel region 130 and the mid region 120 and a force of 5 kg is applied to the intersection of the forefoot region 110 and the mid region 120, the deflection at the intersection of the forefoot region 110 and the mid region 120 is less than about 5 mm—in both lateral and medial directions.

The article of footwear 10 includes an optional insole 170 disposed on the outsole 100, for example as shown in FIGS. 11 and 24. In some examples, the insole 170 comprises a relatively thin (e.g., between about 0.5 mm and about 1.2 mm) non-woven material for allowing substantially direct transmission of forces between the outsole 100 and the user's foot. The insole 170 may be adhered to the outsole 100. In the base portion 114 of the forefoot region 110, the insole 170 is attached only to the ground contact pads 112 (e.g., and not the base portion 114 interconnecting the ground contact pads 112), thereby allowing decoupled movement of the ground contact pads 112 from the base portion 114. For example, if an adhesive is applied to the ground contact pads 112 and also to the base portion 114 and to the flex portions 116, these components of the forefoot region 110 will move as a monolithic sheet, rather than with respect to each other. By attaching (e.g., via adhesive) only the ground contact pads 112 to the insole 170 in the base portion 114, while attaching the insole 170 to the mid region 120, heel region 130, and the remaining peripheral portion 111 of forefoot region 110 (e.g., such as the portions surrounding the base portion 114), the flex portions 116 are allowed to flex (e.g., elastically deform) to allow movement of the ground contact pads 112.

The article of footwear 10 may include a footbed 300 disposed on the shoe outsole 100 (e.g., secured or freely stacked) and/or insole 170 in the void 205 defined by the upper 200 and the outsole 100. The footbed 300 is compliant to conform to and exhibit the shape of the infant's foot bottom and portions of outsole 100. The footbed 300 may be a foam sheet having thickness of between about 1 mm and about 8 mm (preferably between about 2 mm and about 4 mm in the forefoot region 110 and between about 2 mm and about 6 mm in the heel region 130) with a woven or non-woven fabric, or leather covering the foam sheet. At least portions of the footbed 300 can be relatively thin (e.g., between about 2 mm and about 4 mm thick) and conformably to allow transmission of motion of the ground contact pads 112 to a user's foot.

While certain embodiments have been described, other embodiments are possible.

As an example, while the footbed 300 has been described as a foam sheet other embodiments are possible. In some embodiments, referring to FIGS. 29-33, a footbed 302 includes pads 310*a,b* disposed along at least a portion of a base 304 having a forefoot region 306, a heel region 308, and a midsole region 307 substantially between the forefoot region 306 and the heel region 308. The base 304 includes interconnecting portions 316 disposed between adjacent pads 310*a,b*. The interconnecting portions 316 are flexible such that each pad 310*a,b* moves relative to the base 304, substantially independently of the other pads, in response to a force applied to the respective pad 310*a,b*. For example, the pad 310*a,b* to which force is directly applied can move in a direction substantially normal to the base 304 by a distance greater than about 20 percent (e.g., greater than about 50 percent) of the distance moved by adjacent pads that do not receive the directly applied force.

During use, the footbed 302 is disposed on the shoe outsole 100 and/or insole 170 in the void 205 defined by the upper 200 and the outsole 100 in a manner analogous to footbed 300 (see, e.g., FIGS. 11 and 24). At least some of the pads 310*a,b* align with the ground contact pads 112 on the outsole 100 such that force (e.g., in a direction substantially normal to the outsole 100) exerted on one or more ground contact pads 112 is transmitted to respective pads 310*a,b* aligned with the ground contact pads 112 receiving the exerted force such that the pads 310*a,b* move substantially independently of each other and of the base 304 to transmit force to a user's foot. Such transmission of force can improve the proprioceptive feedback to the user to facilitate, for example, effective traversal of uneven and/or slippery terrain (e.g., rocky shorelines).

The base 304 has a first side 312 substantially opposite a second side 314 such that, during use of the article of footwear, the first side 312 is disposed toward a user's foot and the second side 314 is disposed toward the shoe outsole 100. The base 304 defines a sagittal axis 401 extending in a direction parallel to a width dimension of the base 304 and a front axis 403 extending in a direction parallel to a length dimension of the base 304, substantially perpendicular to the sagittal axis 401.

The forefoot region 306 and the heel region 308 each have respective maximum width dimensions parallel to the sagittal axis 401, with the maximum width dimension of the forefoot region 306 being greater than the maximum width dimension of the heel region 308. In some implementations, the larger maximum width dimension of the forefoot region 306 can create an interference fit and/or frictional forces with one or more surfaces of the outsole 100 and/or the upper 200 to facilitate holding the base 304 in place relative to the outsole 100 and/or insole 170 while allowing, for example, the base 304 to be removable from the article of footwear 10 (e.g., for replacement, repair, drying, and/or cleaning). In some implementations, the base 304 is fastened to the article of footwear 10 such that the base 304 remains in substantially fixed relation to the shoe outsole 100 and/or insole 170. For example, adhesive can be applied between the outsole 100 and/or insole 170 and at least a portion of the second side 314 of the base 304. Additionally or alternatively, at least a portion of the base 304 can be fastened stitched to the outsole 100, insole 170, and or upper 200.

The base 304 has a maximum thickness of between about 0.5 mm to about 6 mm and is flexible about an axis parallel to the sagittal axis 401 during use of the article of footwear 10. In this thickness range, the base 304 has a durometer of between about 30 Asker C and about 70 Asker C which can, for example, balance the tradeoff between durability of the article of footwear 10 and comfort for the user. Examples of materials that can be used to form a base having characteristics falling within these thickness and durometer ranges are polyurethane foam and ethylene vinyl acetate (EVA). In some implementations, the thickness of the base 304 is substantially uniform (e.g., varying by less than about two percent) which can, for example, improve proprioceptive feedback of the footbed 302 by facilitating substantially uniform flexibility of the pads 310 disposed along the base 304.

Each pad 310*a,b* is integrally formed with the base 304 such that, as described above, the interconnecting portions 316 of the base 304 extend between the pads 310. The interconnecting portions 316 flex to allow each pad 310*a,b* to move substantially independently of each of the other pads in response to a force applied to the pad 310*a,b*. The integral formation of the pads 310*a,b* and the base can allow the footbed 302 to be formed through cost effective manufacturing processes including, for example, extrusion and/or molding.

Each pad 310*a,b* has a first portion 318 that extends away from the first side 312 of the base 304 and a second portion 320 that extends away from the second side 314 of the base 304. Thus, during use, the first portion 318 of each pad 310*a,b* is oriented toward a user's foot while the second portion 320 of each pad 310*a,b* is oriented toward the outsole 100 and/or insole 170. Force from the outsole 100 and/or insole 170 is transmitted to the second portion 320 of the respective pad 310*a,b* substantially aligned with the portion (e.g., the ground contact pad 112) of the outsole 100 and/or insole 170 receiving the force from the ground and transmitted to the user's foot via the first portion 318 of the pad 310*a,b*. The surface area of the first portion 318 that comes into contact with the user's foot is approximately equal to the surface area of the second portion 320 that comes into contact with the outsole 100 and/or insole 170 to allow the pressure transmitted by the outsole 100 and/or insole 170 to be approximately equal to the pressure exerted on the user's foot during use.

The respective first portions 318 of at least some of the pads 310*a,b* extend away from the first side 312 of the base 304 by a substantially uniform distance (e.g., about 1 mm) to facilitate contact with the user's foot for proprioceptive feedback. As discussed below, the first portions 318 of certain pads 310*a,b* extend away from the first side of the base 304 by a distance of about 0.5 mm to about 2 mm greater than the first portions 318 of other pads 310*a,b*. Such extension of the first portion 318 of the pads in certain areas of the footbed 302 can emphasize proprioceptive feedback to portions of the user's foot in contact with those extended first portions 318 during use of the article of footwear 10.

The respective second portions 320 of the pads 310*a,b* disposed along the forefoot region 306 extend away from the second side 314 of the base 304 by between about 0.5 mm and about 4 mm and the second portions 320 of the pads 310*a,b* disposed along the heel region 308 extend away from the second side 314 of the base 304 by between about 0.5 mm and about 15 mm such that the overall thickness of the footbed 302 in the heel region 308 is greater than the overall thickness of the footbed 302 in the forefoot region 306. Such varying thickness can, for example, facilitate cushioning in the heel region 308 while maintaining finer proprioceptive feedback in the forefoot region 306. The overall thickness of the pads 310*a,b* disposed along the midsole region 307 can be between the thickness of the pads 310*a,b* disposed along the forefoot region 306 and the heel region 308 such that the overall thickness of the footbed 302 is substantially tapered from the heel region 308 to the forefoot region 306.

The pads 310*a* are arranged with centers substantially aligned on a grid (e.g., a hexagonal grid, a triangular grid, or other substantially regularly repeating pattern). The pads 310*a* can provide support to the user's foot while also providing some proprioceptive feedback to the user. The pads 310*b* are arranged along the base 304 to contact specific portions of the user's foot (e.g., the medial ball of the user's foot, the lateral ball of the user's foot, and/or the heel of the user's foot) to emphasize proprioceptive feedback to those areas.

The pads 310*a* can be arranged on a "spherized" grid such that at least some of the pads 310*a* are wrapped around a three-dimensional sphere and mapped onto the two-dimensional grid. Arranging the pads 310*a* along a spherized grid can, for example, improve the proprioceptive feedback of the footbed 302 by improving contact between the pads 310*a* on the grid and the user's foot (e.g., the forefoot) as the user's foot flexes during use of the article of footwear 10. The pads 310*a* have a substantially elliptical (e.g., pill-like) shape as viewed from the top or bottom of the footbed 304. The substantially rounded edges of this shape reduces the likelihood of pressure focal points that could cause discomfort to the user's foot as force is transmitted through the pad 310*a*. Additionally or alternatively, the pill-like shape of the pads 310*a* can allow a large number of pads 310 to be arranged within the area defined by the base 304. Such a high concentration of the pads 310*a* can improve the life of the footbed 302 by, for example, distributing the weight of the user more uniformly across the footbed 302. This can reduce packing out (e.g., permanent deformation) of the footbed 302.

The pads 310*a* can provide direct or indirect proprioceptive feedback to the user's foot. For example, at least some of the pads 310*a* can align with corresponding contact pads 112 on the outsole 100 to provide substantially direct transmission of a ground contact force to the user's foot. Additionally or alternatively, at least some of the pads 310*a* can align with portions of the outsole 100 that do not correspond to the contact pads 112 to provide substantially indirect transmission of a ground contact force to the user's foot.

At least some of the pads 310*b* have first portions 318 extending away from the first side 312 of the base 304 between about 0.25 mm and about 1.5 mm greater than the first portions 318 of the pads 310*a*. Pads 310*b* that extend greater than the pads 310*a* along the first side 312 of the base 304 can make first contact with the user's foot in response to a force, emphasizing proprioceptive feedback along that portion of the user's foot. The second portions 320 of at least some of the pads 310*b* extend away from the second side 314 of the base 304 between about 0.5 mm and about 2 mm greater than the second portions 320 of the pads 310*a*. The pads 310*b* that extend greater than the pads 310*a* along the second side 314 of the base 304 begin independent movement toward the user's foot before less-extensive pads 310*a,b* begin movement. This can also emphasize proprioceptive feedback to the respective portion of the user's foot.

Figure 34:
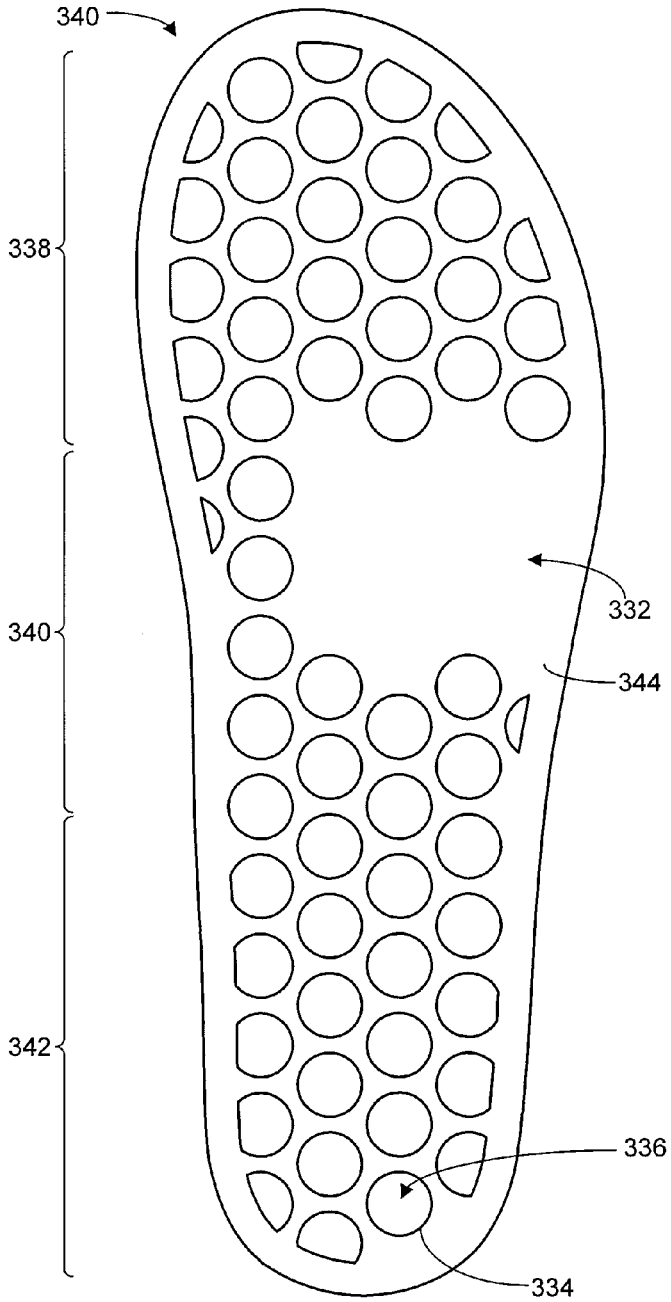
FIG. 34 is a top view of a footbed for an article of footwear.
Figure 35:
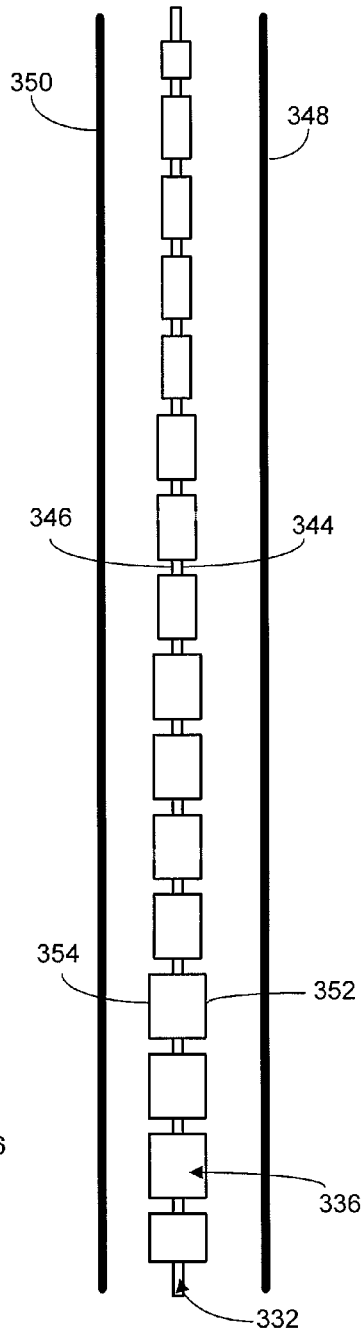
FIG. 35 is a partially exploded side section view of the footbed shown in FIG. 34 along line 34-34.

While the footbed 302 has been described as including the pads 310 integrally formed with the base 304, other embodiments are possible. In some embodiments, referring to FIGS. 34-35, a footbed 340 includes pads 336 disposed along a base 332. The base 332 has a forefoot region 338, a heel region 342, and a midsole region 340 substantially between the forefoot region 338 and the heel region 342 and defines orifices 334 extending from a first side 344 to a second side 346 of the base 332. Each pad 336 is disposed in a corresponding orifice 334 and is substantially free to move within the orifice 334.

During use, the footbed 340 is disposed in an article of footwear 10 with the first side 344 of the base 332 disposed toward a user's foot during use of the article of footwear 10 and the second side 346 of the base disposed toward the outsole 100 and/or insole 170 (e.g., in a manner analogous to footbeds 300 and 302 described above). Each pad 336 moves substantially independently of each of the other pads 336 in response to a force applied to the pad 336 to provide proprioceptive feedback to the user of the article of footwear 10.

The base 332 has a substantially uniform thickness (e.g., about 2.0 mm), and the pads 336 can have a thickness of between about 4 mm and about 16 mm. The pads 336 can be arranged such that the thickest pads 336 are disposed along the heel region 342 to provide cushioning. The thickness of the pads can decrease from the heel region 342 of the base 332 to the forefoot region 338 of the base 332 such that the overall thickness of the footbed 340 tapers down from the heel region 342 to the forefoot region 338.

To reduce the likelihood of the pads 336 becoming dislodged from the orifices 334 during use of the article of footwear 10, sheets 348 and 350 can be fastened to either side of the base 332 and/or pads 336 to cover the respective sides of the pads 336 and the base 332. For example, the sheets 348 and 350 can be fastened to the pads 336 by cement can be applied to faces 352 and 354 of the pads 336. Additionally or alternatively, the sheets 348 and 350 stitch bound around the perimeter of the base 332.

The sheets 348 and 350 can be formed of a stretchable material such as a polyurethane-polyurea copolymer (e.g., Lycra®, available from INVISTA S.à r.l. of Wichita, Kans.). Such stretchable material can allow a degree of travel of the pads 336 within the respective orifices 334 while retaining at least a portion of the pads 336 within the respective orifices 334.

A number of implementations have been described. Nevertheless, it will be understood that various modifications may be made without departing from the spirit and scope of the disclosure. Accordingly, other implementations are within the scope of the following claims.

What is claimed is:

1. A footbed comprising:

a base having a first side opposite a second side, the first and second side each extending from a forefoot region to a heel region;

a plurality of pads, each pad having a first portion substantially opposite a second portion, the first portion extending away from the first side of the base and the second portion extending away from the second side of the base;

wherein the pads are arranged on a spherized grid by wrapping the pads around a three-dimensional sphere and mapping the pads to a two-dimensional grid; and wherein the second side of the base is positionable adjacent to an outsole of an article of footwear such that the first side of the base is adjacent a user's foot during use of the article of footwear, and each pad is movable substantially independently of the each of the other pads, relative to the base, in response to a force applied to the respective pad during use of the article of footwear.

2. The footbed of claim 1, wherein the plurality of pads are interconnected by the base.

3. The footbed of claim 2, wherein at least some of the plurality of pads are arranged on a triangular spherized grid or hexagonal spherized grid.

4. The footbed of claim 1, wherein the base defines a plurality of orifices extending from the first side of the base to the second side of the base, each of the plurality of pads disposed in a corresponding orifice and free to move within the orifice.

5. The footbed of claim 1, wherein the base has a substantially uniform thickness of between about 0.5 mm to about 6 mm from the forefoot region to the heel region.

6. The footbed of claim 1, wherein at least some of the plurality of pads are disposed along the forefoot region and at least some of the plurality of pads are disposed along the heel region, the pads at the heel region having a thickness greater than the pads at the forefoot region.

7. The footbed of claim 6, wherein the first portion of each of the plurality of pads extends away from the first side of the base by a substantially uniform distance.

8. The footbed of claim 6, wherein the second portion of at least one of the pads extends away from the second side of the base by a distance greater than at least one of the other pads extending away from the second side.

9. The footbed of claim 8, wherein the at least one pad extending away from the second side by a distance greater than at least one of the other pads is disposed along the forefoot region.

10. The footbed of claim 8, wherein the at least one pad extending away from the second side of the base by a distance of between about 0.5 mm to about 2 mm greater than at least one of the other pads extending away from the second side of the base.

11. The footbed of claim 6, wherein the second portion of each pad at the forefoot region extends away from the second side of the base by a first distance and the second portion of each pad at the heel region extends away from the second side of the base by a second distance greater than the first distance.

12. The footbed of claim 11, wherein the first distance is between about 0.5 mm and about 4 mm and the second distance is between about 5 mm and about 15 mm.

13. The footbed of claim 1, wherein at least some of the plurality of pads have a substantially elliptical shape and at least some of the plurality of pads are arranged in a spherized grid pattern.

14. The footbed of claim 1, wherein at least some of the plurality of pads are disposed along the base such that at least one of the pads contacts the ball of a user's foot during use of the article of footwear.

15. The footbed of claim 1, wherein the base and the plurality of pads are made of: polyurethane foam or ethylene vinyl acetate.

16. The footbed of claim 1, wherein the base has a durometer of between about 30 Asker C and about 70 Asker C.

17. The footbed of claim 1, wherein the forefoot region of the base has a sagittal dimension greater than the sagittal dimension of the heel region of the base.

* * * * *